US007738809B2

(12) United States Patent
Tao et al.

(10) Patent No.: US 7,738,809 B2
(45) Date of Patent: Jun. 15, 2010

(54) IMAGE FORMING SYSTEM INCLUDING FINISHER APPLYING PUNCHING PROCESSING AND STAPLE PROCESSING TO PRINTED PAPERS, AND IMAGE FORMING APPARATUS HAVING MECHANISM FOR PRINTING ON BOTH SURFACES OF PAPER

(75) Inventors: Kozo Tao, Osaka (JP); Kyoichiro Hayashi, Osaka (JP); Naoki Takeuchi, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 194 days.

(21) Appl. No.: 11/772,733

(22) Filed: Jul. 2, 2007

(65) Prior Publication Data

US 2008/0008491 A1 Jan. 10, 2008

(30) Foreign Application Priority Data

Jul. 5, 2006 (JP) ..... 2006-185458
Jul. 5, 2006 (JP) ..... 2006-185459
Jul. 5, 2006 (JP) ..... 2006-185460
Jul. 5, 2006 (JP) ..... 2006-185461

(51) Int. Cl.
*G03G 15/00* (2006.01)

(52) U.S. Cl. ..... 399/85; 399/82; 399/83; 399/18; 399/407; 399/408; 399/410

(58) Field of Classification Search ..... 399/82, 399/83, 85, 9, 18, 87, 407–411
See application file for complete search history.

(56) References Cited

U.S. PATENT DOCUMENTS

| | | | | |
|---|---|---|---|---|
| 6,076,817 | A * | 6/2000 | Kobayashi et al. | 270/58.09 |
| 6,088,568 | A | 7/2000 | Ohtani | |
| 6,229,984 | B1 | 5/2001 | Ohtani | |
| 2002/0131786 | A1 * | 9/2002 | Sato et al. | 399/82 |
| 2005/0206064 | A1 | 9/2005 | Moriyama et al. | |
| 2006/0067724 | A1 * | 3/2006 | Sato | 399/82 |
| 2008/0258371 | A1 | 10/2008 | Moriyama et al. | |

FOREIGN PATENT DOCUMENTS

| | | | |
|---|---|---|---|
| CN | 1669806 | A | 9/2005 |
| JP | 03063192 | A | 3/1991 |
| JP | 08-272160 | | 10/1996 |
| JP | 08272160 | A | 10/1996 |
| JP | 10-236720 | | 9/1998 |
| JP | 10236720 | A | 9/1998 |

* cited by examiner

*Primary Examiner*—David M Gray
*Assistant Examiner*—Rodney Bonnette
(74) *Attorney, Agent, or Firm*—Hogan & Hartson LLP

(57) ABSTRACT

An image forming system is given, in advance, unique setting as a behavior to be performed when an error occurs regarding postprocessing. In a case where the postprocessing becomes inexecutable during the operation of the system, the system either cancels the postprocessing to continue printing (Steps S20, S22) or stops printing to generate an error (Step S18), based on the unique setting. A user arbitrarily decides the unique setting, which enables optimum control of the operation that the system should perform when the postprocessing becomes inexecutable.

18 Claims, 15 Drawing Sheets

IMAGE FORMING SYSTEM INCLUDING FINISHER APPLYING PUNCHING PROCESSING AND STAPLE PROCESSING TO PRINTED PAPERS, AND IMAGE FORMING APPARATUS HAVING MECHANISM FOR PRINTING ON BOTH SURFACES OF PAPER

BACKGROUND OF THE INVENTION

1. Field of the Invention

The present invention relates to an image forming system, more particularly, to an image forming system including a finisher which is capable of applying postprocessing such as punching and stapling to printed or copied papers before discharging the printed or copied papers.

The present invention also relates to an image forming apparatus, more particularly, to an image forming apparatus having a function of printing on both surfaces of a paper.

2. Description of the Related Art

Generally, a finisher is used in combination with an image forming apparatus such as a printer or a copier. The printer or the copier discharges printed or copied papers sheet by sheet. When receiving the discharged papers, the finisher stacks them in sequence at one place. Or, the finisher opens punch holes in the received papers and thereafter stacks the received papers in sequence at one place. Then, the finisher staples a bundle of a certain number of the stacked papers.

In the image forming system including the finisher, an instruction to bundle and staple the printed papers or to open the punch holes in the printed papers is given by a command included in print command data. The contents designated by the print command data include information on a stapling position for stapling the papers, punching positions for opening the punch holes in the papers, and so on.

Further, in the system, in a case where the designated staple position is out of a movable range of a stapling mechanism or in a case where the designated punching positions are out of a movable range of a punching mechanism, the stapling instruction or the punching instruction itself is automatically deleted from the print command data. This prevents the system from stopping printing or becoming inoperable due to the inexecutable stapling instruction or punching instruction, and allows forcible continuation of print processing.

As a machine, such a system can be thought to be effective in that the progress of its print processing does not become stagnant and thus its operating efficiency is not lowered even if an inexecutable instruction is given. However, such an operation of the machine makes a user feel odd or distrustful about the machine because, if the machine actually finishes only the print processing regardless of the user's stapling or punching instruction which the user has surely given, the user cannot immediately understand why his/her instruction is disregarded. The user possibly misunderstands that the machine is out of order.

Further, when a user gives an inexecutable stapling instruction or punching instruction, the system deletes the user's instruction without a user's permission in pursuit of operating efficiency as a machine. Consequently, the system completely disregards the stapling or punching desired by the user, which is not convenient for the user. When the user definitely desires the postprocessing, the user has to take repeated trouble of setting the stapling position or punching positions in the system again, which lowers efficiency rather than improving it.

Therefore, a system having a finisher needs to realize improvement both in work efficiency and usability in a well-balanced manner.

Further, an image forming apparatus is generally capable of both single-sided printing and double-sided printing on a paper. However, if a medium not suitable for the double-sided printing such as, for example, used paper (with one side printed) or translucent paper is set in the image forming apparatus, the image forming apparatus does not execute a job in which the double-sided printing is instructed, even if a user tries to have the system execute the double-sided printing. This can prevent a mistake that the double-sided printing is erroneously executed on the paper not suitable for the double-sided printing and can save the waste of paper and toner.

Thus, from the viewpoint of preventing the user's erroneous copying, it can be indeed said to be effective that the image forming apparatus automatically stops its operation on its own judgment. However, if the image forming apparatus completely stops its operation without any notice only because a paper not suitable for the double-sided printing (used paper, translucent paper, or the like) is set, the work of the user waiting for the printing does not progress at all. This lowers work efficiency for many users.

Therefore, the image forming apparatus is required not only to simply reduce waste by preventing improper double-sided printing but also to contribute to improvement in work efficiency of a user.

SUMMARY OF THE INVENTION

The present invention disclosed and claimed herein, in one aspect thereof, comprises an image forming system. This image forming system comprises: an image forming apparatus processing image data page by page and printing, on a paper, an image formed based on the processed image data to discharge the printed paper; and a finisher receiving the printed paper discharged from the image forming apparatus and executing one of an operation of applying predetermined postprocessing to the printed paper to discharge the postprocessed printed paper and an operation of discharging the printed paper discharged from the image forming apparatus without applying the postprocessing to the printed paper. The system further comprises a controller. The controller processes the image data in a unit of a job when the image forming apparatus forms the image, sets in a job that the finisher should perform the postprocessing, and when a predetermined error regarding the postprocessing occurs while the image forming apparatus is executing an operation for forming the image in the set state, performs control to make each of the image forming apparatus and the finisher execute a preset unique operation.

Further scope of applicability of the present invention will become apparent from the detailed description given hereinafter. The detailed description and embodiments are only given as examples though showing preferred embodiments of the present invention, and therefore, from the contents of the following detailed description, changes and modifications of various kinds within the spirits and scope of the invention will become apparent to those skilled in the art.

BRIEF DESCRIPTION OF THE DRAWINGS

The present invention will be fully understood from the following detailed description and the accompanying drawings. The accompanying drawings only show examples and are not intended to restrict the present invention. In the accompanying drawings.

DETAILED DESCRIPTION

Figure 1:
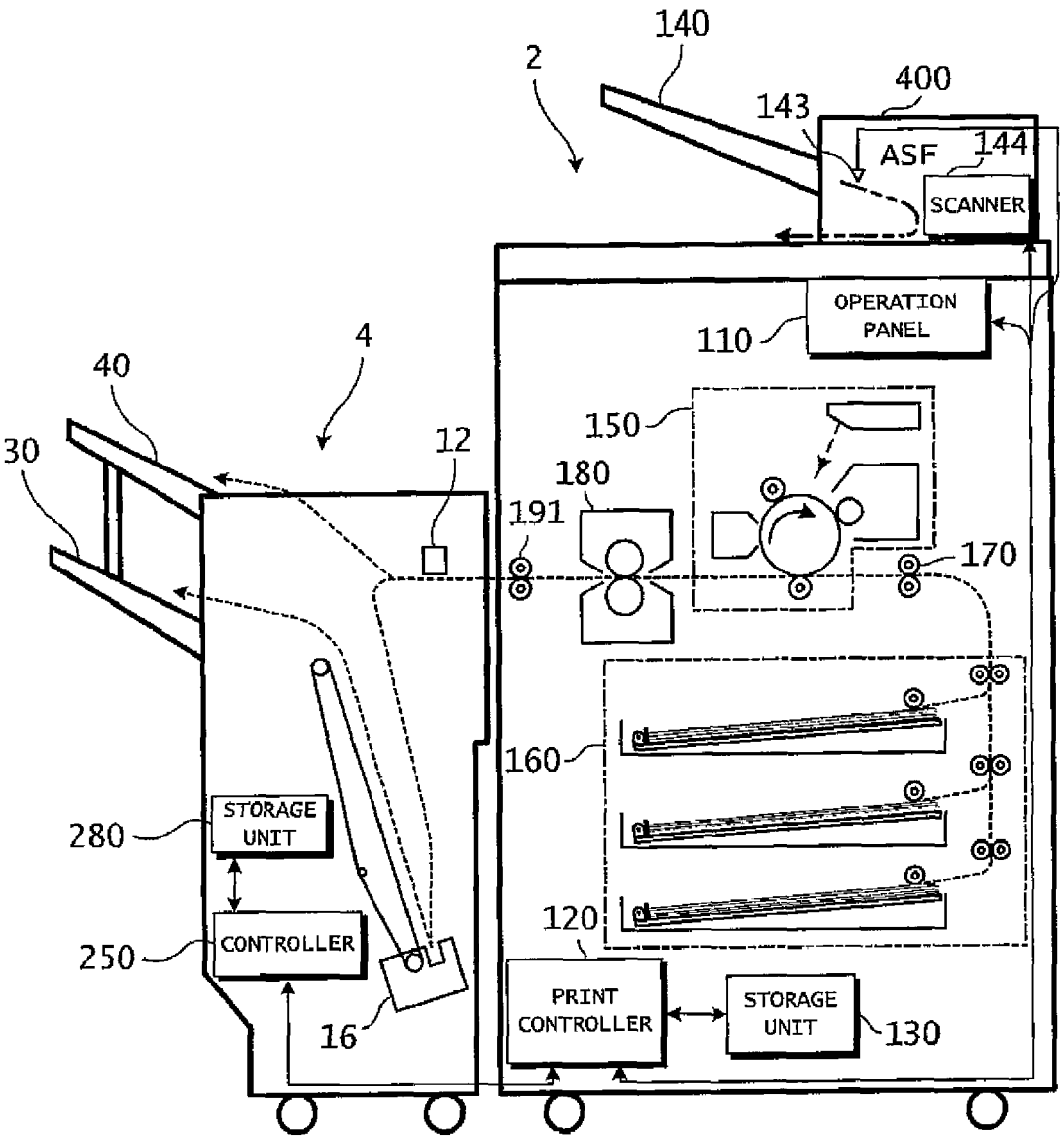
FIG. 1 is a view schematically showing the structure of an image forming system.

FIG. 1 schematically shows the structure of an image forming system. This system includes, for example, a copier 2 and a finisher 4. The system operates in a state where the finisher 4 is adjacently coupled to the copier 2. The copier 2 may be a multifunction device. The multifunction device has not only a function as a copier but also functions of a fax machine, a network printer, a network scanner, and so on.

The copier 2 is provided with a print controller 120. The finisher 4 is provided with another controller 250. Each of these controllers 120, 250 is constituted of, for example, an electronic circuit including a central processing unit (CPU). The circuits are built in the copier 2 and the finisher 4 respectively, each being formed on a circuit board. Further, storage units 130, 280 are connected to the controllers 120, 250 respectively. Concrete examples of these storage units 130, 280 are a semiconductor memory (ROM, RAM), a hard disk drive, a magneto-optic recording device (RAM disk), and so on.

Data that a user sets by operating an operation panel 110 when using the copier 2 are processed by the print controller 120 and are stored in the storage unit 130. This setting includes the size, type, and feeding direction of a paper, copy density, frame erase, binding margins, processing for integrating a plurality of pages on one page (so-called "2-in-1" or "4-in-1"), and so on. The print controller 120 executes image processing according to the setting. The time taken for the print controller 120 to execute the image processing depends on the contents of the setting. An application program for multithreaded processing is stored in the storage unit 130.

For example, in image processing involving copying of originals, when a user sets the originals on a tray 140 of an auto sheet feeder 400 and presses a start key (not shown) of the operation panel 110, the print controller 120 performs the following processing in response to the user's operation. First, when a paper sensor 143 installed in the ASF 400 detects the originals, the print controller 120 causes the ASF 400 to feed the originals sheet by sheet and causes a scanner 144 to scan images of the originals in the course of the feeding. The print controller 120 converts the images scanned by the scanner 144 into data, and stores the image data in the storage unit 130 in a unit of a job.

After applying preprocessing such as image noise filtering to the image data, the print controller 120 performs the image processing according to the settings of various kinds to supply the processed data to a print engine 150 page by page. Consequently, an electrostatic latent image is formed on a surface of a photosensitive drum of the print engine 150, and the electrostatic latent image is developed with a toner.

Meanwhile, inside the copier 2, a paper taken out from a paper feeder 160 is sent to a resist roller 170 and is tentatively stopped here. When the photosensitive drum of the print engine 150 rotates to reach a predetermined angle, the paper is sent by the resist roller 170 at this timing. Consequently, the toner image is transferred to the paper from the surface of the photosensitive drum. This paper passes through a fuser unit 180 to be heated and pressed here, so that the toner image is fixed on the paper. The paper bearing the transferred toner image becomes a copy and this copy passes between a pair of discharge rollers 191 to be discharged and delivered to the finisher 4.

Figure 2:
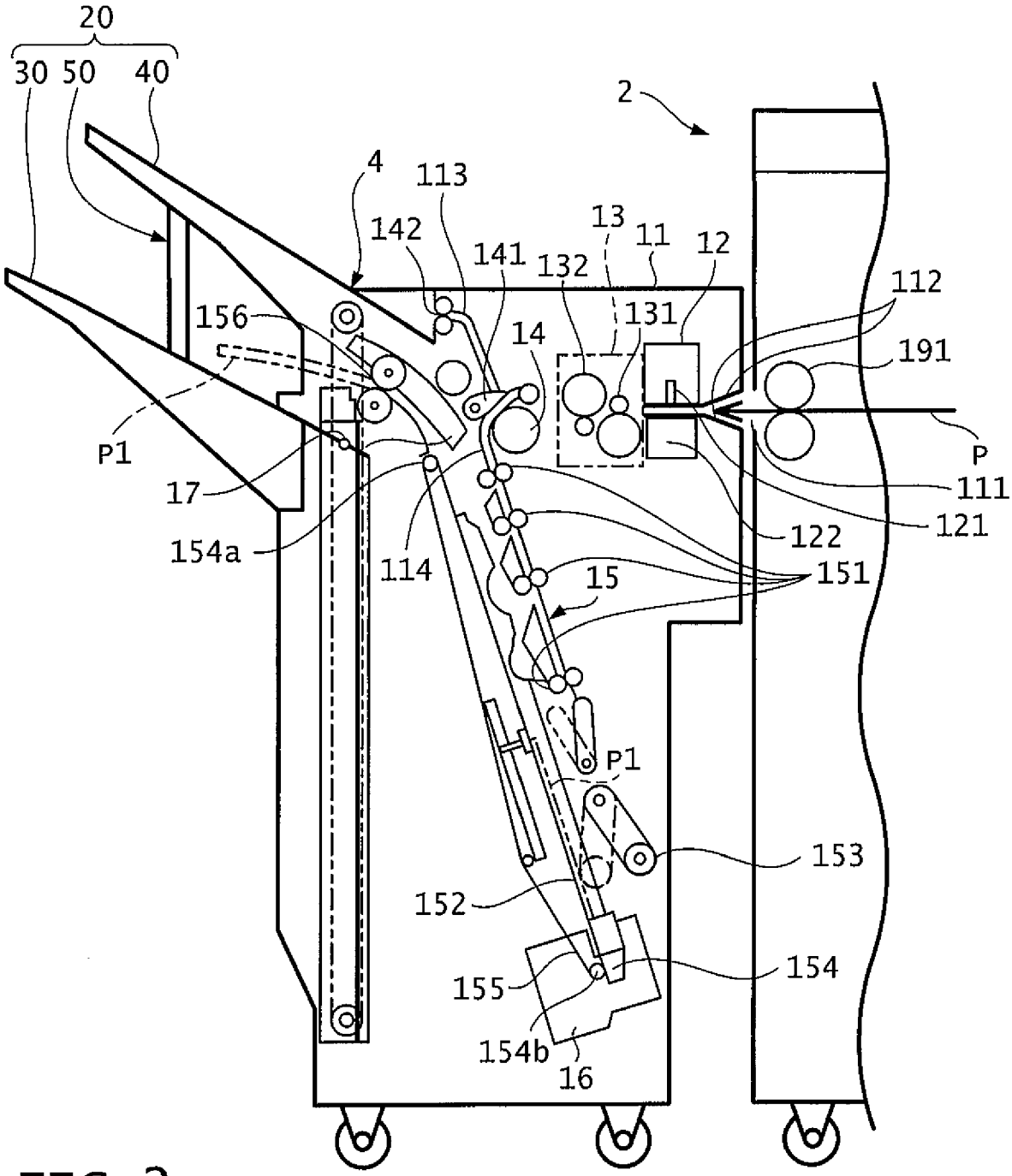
FIG. 2 is a view to illustrate the internal structure of a finisher.

FIG. 2 shows the internal structure of the finisher 4. The finisher 4 opens filing holes in a copy P or binds a temporarily stocked copy bundle P1 with a staple. In the following description, the opening of holes will be referred to as "punching processing" and the binding will be referred to as "staple processing". The punched or stapled copies P are discharged from the finisher 4 as postprocessed products.

The finisher 4 includes a housing 11 having a substantially cuboid shape. In the housing 11, a loading port 111 is formed in a portion facing the discharge roller pair 191 of the copier 2. Further, on a side surface, of the housing 11, opposite the loading port 111, a discharge unit 20 receiving the copies P discharged from the finisher 4 is provided.

The discharge unit 20 has two trays arranged in two upper and lower tiers. Out of these, the one positioned on the lower side is a main tray 30 and the one positioned on the upper side is a sub tray 40. The copy bundle P1 having undergone the staple processing is discharged to the main tray 30. The staple processing is performed while a discharge mode of the finisher 4 is set to a staple mode. When the staple mode is set, the finisher 4 performs operations of temporarily keeping the copy bundle P1 on a center portion of the housing 11, applying the staple processing here to the copy bundle P1, and thereafter discharging the stapled copy bundle P1 to the main tray 30.

The copies P not having undergone the staple processing are discharged sheet by sheet to the other sub tray 40. Between the main tray 30 and the sub tray 40, a paper aligner 50 aligning the copy bundles P1 on the main tray 30 is provided. The trays 30, 40 are inclined upward in a copy discharge direction. The discharge mode set in the finisher 4 includes not only the aforesaid staple mode but also modes in which the stale processing is not performed such as a non-staple mode, a sorting mode, a non-sorting mode, and so on.

In any case, the copies P discharged from the discharge roller pair 191 of the copier 2 are led into the finisher 4, undergo the punching processing and/or the staple processing here if necessary, and thereafter are discharged either to the main tray 30 or to the sub tray 40 as is predetermined. The copy P includes not only a plain paper but also a tracing paper, an OHP sheet, and other sheet-type recording media.

A pair of upper and lower guide plates 112 is provided in the loading port 111. These guide plates 112 are arranged to taper off (become closer to each other) from an upstream side to a downstream side when seen in the discharge direction of the copy P. A punching machine 12 for performing the aforesaid punching processing is disposed at a position adjacent to the loading port 111. The copy P discharged from the discharge roller pair 191 is conveyed to the punching machine 12 while being guided by the guide plates 112.

The punching machine 12 includes, for example, two punch rods 121 for punching. These punch rods 121 are arranged in a direction perpendicular to the discharge direction of the copy P to be a predetermined interval (for example, an interval prescribed for two-hole binding) apart from each other. The punching machine 12, when the copy P is conveyed thereto, temporarily stops a leading end of the copy P by a stopper (not shown) and moves down the punch rods 121 while keeping the copy P positioned there, thereby opening punching holes at predetermined positions of the copy P. The punch rods 121 penetrate the copy P as they go down and enter predetermined punch receiving holes provided in a base positioned further downward. Under the punching machine 12, a punch chip collector 122 is disposed and punch chips produced by the punching (portions cut out by the punching) are collected in the punch chip collector 122. Then, when the stopper of the punching machine 12 retreats after the punching processing is thus applied to the copy P, the discharge roller pair 191 is driven to send the copy P to a curl presser 13.

The curl presser 13 eliminates curl (curving) which occurs in the copy P when the copy P is heated in the fusing processing in the copier 2. The curl presser 13 includes two sets of curl pressing roller pairs 131, 132. The two sets of the curl pressing roller pairs 131, 132 correct curls in opposite directions respectively to return the copy P to a flat state. The direction of the curl differs depending on an image formation state on the copy P (whether an image is copied on one surface or both surfaces of the copy P), and in a case where the copier 2 has a double-sided printing mechanism, the correction in the both directions is especially effective.

In the housing 11, a pair of large and small conveyor rollers 14 is disposed at a position on a downstream side of the curl presser 13 when seen in the paper discharge direction. On a further downstream side of the conveyor roller pair 14, there are formed a first conveyance path 113 extending obliquely upward toward the sub tray 40 and a second conveyance path 114 extending obliquely downward in the opposite direction, and these first conveyance path 113 and second conveyance path 114 branch at the position of the conveyor roller pair 14 upward and downward respectively. At this branch point, a branching claw 141 is disposed, and a conveyance destination of the copy P can be switched between the first and second conveyance paths 113, 114 by the branching claw 141. That is, when the branching claw 141 closes the second conveyance path 114, the first conveyance path 113 becomes open. The copy P sent out from the conveyor roller pair 14 in this state is guided by the branching claw 141 and the first conveyance path 113 to be conveyed to a nip portion of a discharge roller pair 142 for sub tray and is discharged to the sub tray 40 when the discharge roller pair 142 for sub tray is driven. On the other hand, when the branching claw 141 closes the first conveyance path 113, the second conveyance path 114 becomes open this time, and the copy P sent out from the conveyor roller pair 14 is guided by the branching claw 141 and the second conveyance path 114 to be conveyed to the intermediate tray 15.

In the second conveyance path 114, four paper loading mechanisms 151 are serially arranged in sequence. The copy P is guided by these paper loading mechanisms 151 onto a paper receiving stand 152 of the intermediate tray 15 via a rout which differs depending on the size. The paper receiving stand 152 has a capacity that is set large enough to hold a plurality of (for example, about 20 sheets of plain paper) of the copies P. The copy P sent onto the paper receiving stand 152 is further sent downward by a presser roller 153 and is set fixed while positioned by the stopper member, 154. A copy P conveyed next via the second conveyance path 114 is stacked on the previous copy P, being positioned by the stopper member 154 with its transfer surface (in a case of single-sided printing) facing a rear surface of the previous copy P. When a copy bundle P1 consisting of a plurality of the aligned copies P is thus formed on the paper receiving stand 152, a stapler 16 applies the staple processing to the copy bundle P1.

A driving pulley 154*a* is disposed near an upper end of the second conveyance path 114, that is, at the uppermost position of the paper receiving stand 152. A driven pulley 154*b* is disposed near a lower end of the second conveyance path 114, that is, at the lowest position of the paper receiving stand 152. An endless belt 155 is hung around the pulleys 154*a*, 154*b* and the aforesaid stopper member 154 is fixed to the endless belt 155. Therefore, when the driving pulley 154*a* is rotated after the copy bundle P1 undergoes the staple processing, the copy bundle P1 supported by the stopper member 154 is lifted up to be conveyed to a nip portion of a discharge roller pair 156. Then, the copy bundle P1 is discharged onto the main tray 30 when the discharge roller pair 156 is driven.

The main tray 30 is movable in the up and down direction along a side surface of the finisher 4. In the finisher 4, an upper surface position of the main tray 30 is sensed by a sensor 17, and the main tray 30 is controlled so that its upper surface is positioned at a height most appropriate for the main tray 30 to hold the copy bundle P1. Therefore, even when a large number of the copies P are discharged onto the main tray 30, the already discharged copy bundle P1 held on the main tray 30 does not interfere the discharge of a newly discharged copy bundle P1.

The copy bundles P1 which are sequentially discharged from the paper receiving stand 152 onto the main tray 30 via the discharge roller pair 156 when the endless belt 155 is driven are aligned by the operation of the paper aligner 50, which solves inconvenience that the plural stacked copy bundles P1 get out of order.

As described above, the finisher 4 has the function of applying the punching processing and the staple processing to the copies P. In the image forming system, whether to execute the punching processing and/or the staple processing in the finisher 4 can be set for each job by, for example, a user's operation of the operation panel 110 of the copier 2.

Specifically, to request to open filing holes in copies P in a job to be executed, a user can designate the setting used for the execution of the punching processing in the finisher 4, by performing a predetermined operation (for example, a button operation, a touch operation, or the like) via the operation panel 110.

Or, to request to bundle copies P and staple the bundle in a job to be executed, a user can designate the setting used for the execution of the staple processing in the finisher 4, by performing a predetermined operation (for example, a button operation, a touch operation, or the like) via the operation panel 110. Further, a user can also designate the setting used for the execution of both the aforesaid punching processing and staple processing in a job to be executed.

The contents (set values) set by the user for each job are accepted by the print controller 120 of the copier 2 to be temporarily stored in the storage unit 130 (for example, a RAM). Then, the print controller 120 transmits a command to the controller 250 based on the setting for each job. This command includes information for each job regarding the type and size of paper, the number of copies, printing manner (single sided or double sided), and so on, and also includes the designation contents regarding the aforesaid punching processing or staple processing. Incidentally, the printing manner such as single sided or double sided is the setting that becomes effective when the copier 2 includes the double-sided printing mechanism. The controller 250 controls the operations of the punching machine 12 and the stapler 16 based on the received command, and also controls the operations of the branching claw 141, the paper loading mechanisms 151, and the driving pulley 154*a*, the ascending/descending movement of the main tray 30, and so on. As a result, if a user performs an operation of setting the contents of the postprocessing individually for each job, the finisher 4 performs necessary operations of various kinds according to the setting.

In addition to the above-described basic operations, the image forming system performs a plurality of the following operations regarding various errors which occur when the finisher 4 executes the processing.

First, an example of an error which occurs when the finisher 4 executes the processing will be described.

In a case where a user sets the staple processing in a job to be executed, copies P discharged from the copier 2 should be sequentially sent to the second conveyance path 114 in order to undergo the staple processing by the stapler 16 in the finisher 4. However, since there is a limit to the number of sheets to be stapled by the stapler 16 (for example, about 20 sheets) as described above, the finisher 4 cannot apply the staple processing to all pages if the number of sheets to be stapled set in the job exceeds the limit number, and consequently, an error occurs in the postprocessing.

Further, in a case where a user sets the staple processing in a job to be executed, if the stapler 16 does not have a sufficient stock of staples (or staples in the stapler 16 are used up), the staple processing cannot be executed for this job, which is considered as an error regarding the postprocessing.

Further, in a case where a user sets the punching processing in a job to be executed, the punching machine 12 should be operated to punch filing holes in the copies P. However, if the aforesaid punching chip collector 122 is full (capacity punch chips) when the job is tried to be executed, this is considered as an error regarding the postprocessing in order to avoid a machine trouble due to punch chip clogging.

Further, the size or type of papers used for a job is not sometimes suitable for the postprocessing such as the punching processing or the staple processing. For example, if the punching processing is set even though relatively small-sized paper (postcard size or the like) is used, or if the staple processing is set even though relatively thick papers, envelops, post cards, or the like are used, the postprocessing itself is inexecutable (interdiction), which is also considered as an error regarding the postprocessing.

As described above, the print controller 120 controls the system in the optimum manner by anticipating an error thus likely to occur regarding the postprocessing performed by the finisher 4. Hereinafter, a plurality of examples of the control performed by the print controller 120 will be described.

FIRST EXAMPLE

Figure 3:
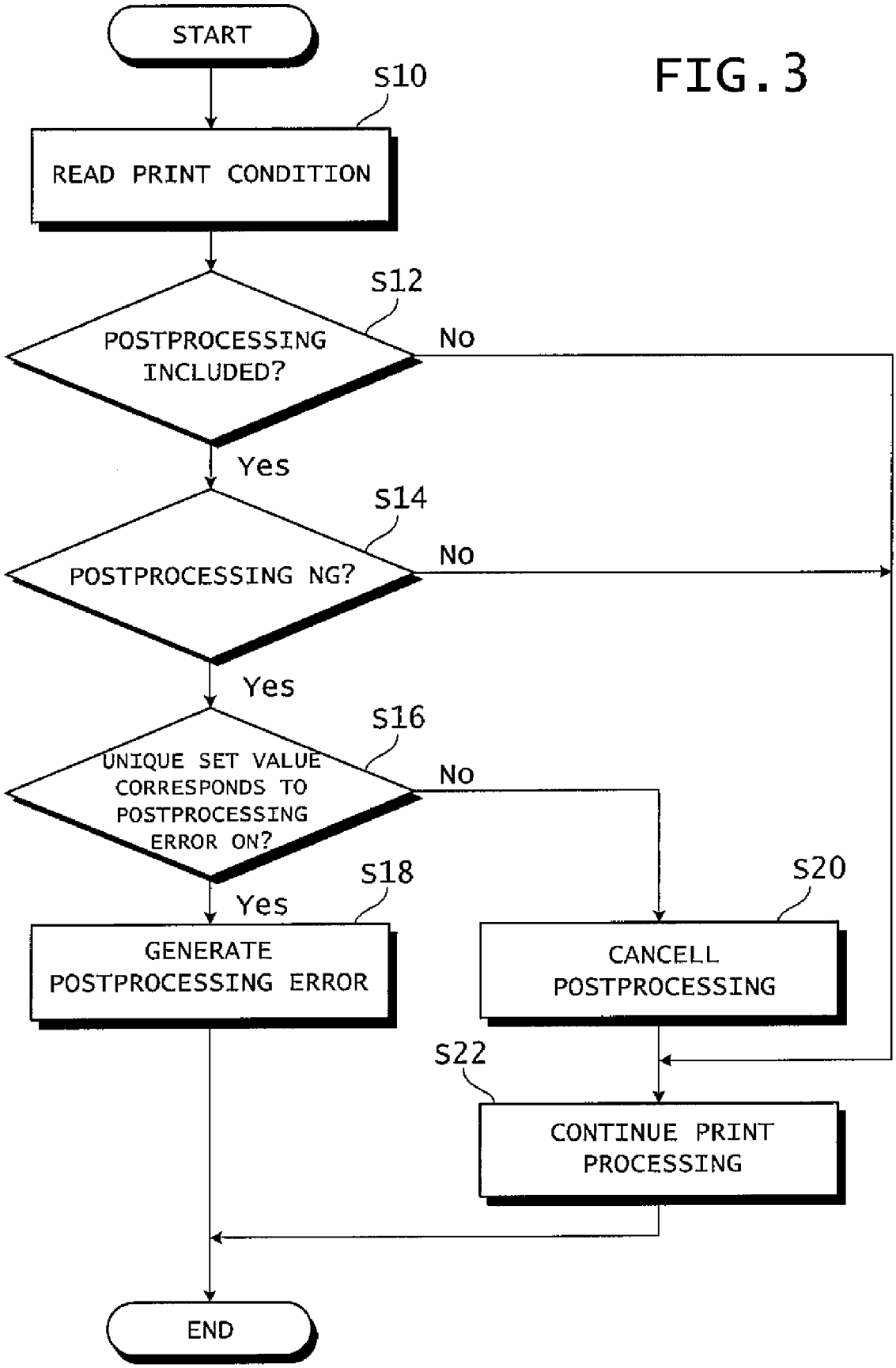
FIG. 3 is a flowchart showing a first example of control processing executed by a print controller.

FIG. 3 is a flowchart showing a first example of control processing executed by the print controller 120. After completing the image forming processing (drawing), the print controller 120 subsequently executes the processing in FIG. 3 as the first example. Hereinafter, the concrete procedure will be described in order of events.

Step S10: The print controller 120 reads, from the storage unit 130, a print condition set for a current job. As described above, the print condition is decided based on the contents which are set by a user for each job via the operation panel 110, and is stored in the storage unit 130.

Step S12: Next, the print controller 120 determines whether or not the read print condition includes the setting regarding the postprocessing. Concretely, the print controller 120 determines whether or not the print condition includes the setting of the postprocessing such as the aforesaid staple processing or punching processing. When no special setting regarding the postprocessing is included (No), the print controller 120 continues the print processing (Step S22 in FIG. 3) and once finishes the control processing. On the other hand, when the setting regarding the postprocessing is included (Yes), the print controller 120 goes to the next Step S14.

Step S14: The print controller 120 determines whether or not an error (NG) regarding the postprocessing is occurring in the current job. Concretely, the print controller 120 determines whether or not any of the aforesaid various errors is occurring in the current job. When it is determined as a result that no special error is occurring (No), the print controller 120 continues the print processing (Step S22 in FIG. 3) and once finishes the control processing. On the other hand, when any error is occurring (Yes), the print controller 120 goes to the next Step S16.

Step S16: The print controller 120 determines whether or not a set value unique to the image forming system (unique set value) indicates that a postprocessing error should be generated. The unique set value mentioned here means a unique value representing what operation (behavior) the image forming system should take when an error regarding the postprocessing occurs. Such a unique set value is stored in the storage unit 130 of the copier 2 in advance, and the unique set value read from the storage unit 130 is a basis of the determination at Step S16 by the print controller 120.

There are mainly two unique set values, for instance. The first one is a set value corresponding to a series of operations of stopping the operation of the image forming system to generate the postprocessing error (represented by ON in binary) when an error regarding the postprocessing occurs. The second one is a set value corresponding to a series of operations of automatically canceling the postprocessing and continuing the print processing without generating the postprocessing error (represented by OFF) when an error occurs. When the image forming system has the former first unique set value (=ON) (Step S16=Yes), the print controller 120 goes to the next Step S18. On the other hand, when the image forming system has the latter second unique set value (=OFF) (Step S16=No), the print controller 120 goes to another Step S20 and then to Step S22. Hereinafter, these steps will be described.

Step S18: The print controller 120 generates the postprocessing error based on the unique set value of the image forming system. Accordingly, the print controller 120 stops the operation of the image forming system. After generating the postprocessing error, the print controller 120, for instance, causes character information such as an error message to be displayed on the operation panel 110 or causes error warning sound to be outputted.

Step S20: The print controller 120 automatically cancels the postprocessing based on the unique set value of the image forming system. Consequently, the postprocessing set by the user in the current job is canceled.

Step S22: After canceling the postprocessing at Step S20, the print controller 120 continues the print processing in this state. In this case, copies P are discharged in sequence onto, for example, the upper sub tray 40 without undergoing the postprocessing such as the staple processing or the punching processing.

SECOND EXAMPLE

Figure 4:
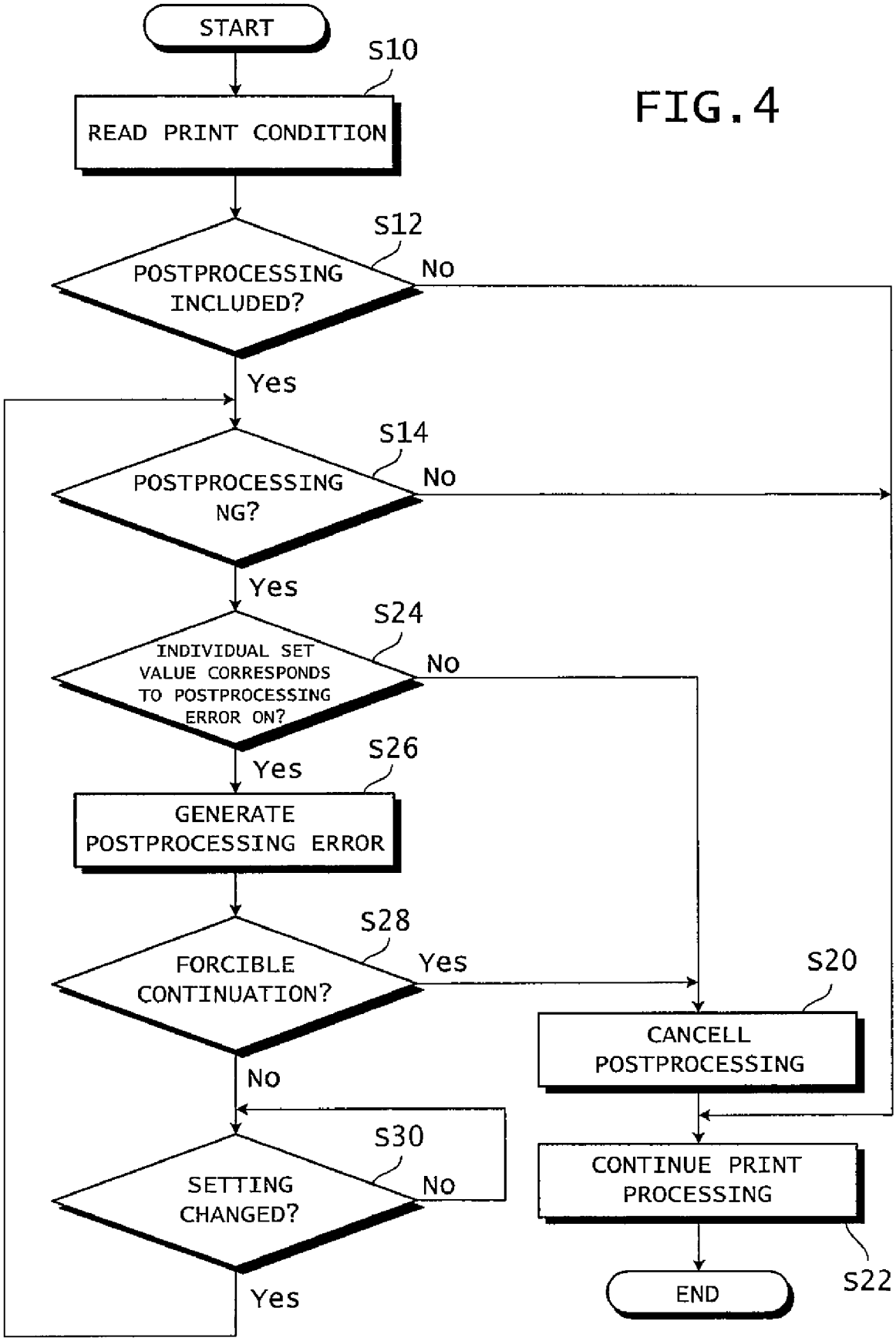
FIG. 4 is a flowchart showing a second example of the control processing executed by the print controller.

Next, FIG. 4 is a flowchart showing a second example of processing executed by the print controller 120. After completing the image forming processing (drawing), the print controller 120 can also subsequently execute the processing in FIG. 4 as the second example. Processes at Step S10 to Step S14 in FIG. 4 are the same as those at Step S10 to Step S14 of the first example previously described, and therefore, only processes different from those of the first example will be described below.

Step S24: The print controller 120 determines whether or not an individually set value (individual set value) indicates that the postprocessing error should be generated. The individual set value mentioned here is a value individually set and representing what operation (behavior) the image forming system should take when an error regarding the postprocessing occurs. For example, the individual set value can be set for each job executed by a user, for each division where the image forming system is installed (each section in the same company), for each print color condition (monochrome or full color), or for each paper size (medium type).

For example, when a user sets the staple processing or the punching processing in a job, the user decides the individual set value for each Job by operating the operation panel 110 (selects it from a menu or the like). In this case, the operation panel 110 displays character information saying, "Do you want to once stop printing when the postprocessing cannot be executed?" or the like, and also displays menu buttons for "stop printing" and "print without postprocessing", for instance. The user can decide the individual set value for each job by pressing the menu button as he/she desires.

The set value (ON/OFF) thus individually decided is stored (updated) in the storage unit 130 of the copier 2 every time it is decided. Then, the print controller 120 reads the individual set value from the storage unit 130 every time a job is executed in the image forming system, and the read set value serves as a basis of the determination at Step S24 by the print controller 120.

There are also mainly two individual set values, but what they indicate are different from those in the first example. Specifically, the first one is a set value corresponding to a series of operations of stopping the operation of the image forming system to generate a postprocessing error and requesting a user's selection (instruction) regarding a subsequent operation (represented by ON) when an error regarding the postprocessing occurs. The second one is a set value corresponding to a series of operations of automatically canceling the postprocessing and continuing the print processing without generating the postprocessing error (represented by OFF) when an error occurs. A user can set which one to use as the individual set value for each job each time, or can set it in advance for each division, or can automatically set it in relation to a print color condition or used paper size in each job.

In any case, when the former first individual set value (=ON) is given (Step S24=Yes), the print controller 120 goes to processes at and after Step S26. On the other hand, when the latter second individual set value (=OFF) is given (Step S24=No), the print controller 120 goes to another Step S20 and then to Step S22. Processes in a case where the print controller 120 goes from here to Steps S20, S22 are the same as those in the first example described above. Hereinafter, a case where the print controller 120 goes from here to Step S26 will be described.

Step S26: The print controller 120 generates the postprocessing error based on the individual set value of the image forming system. Accordingly, the print controller 120 stops the operation of the image forming system. Further, after generating the postprocessing error, the print controller 120, for example, causes character information such as an error message to be displayed on the operation panel 110 or causes error warning sound to be outputted.

Step S28: After generating the postprocessing error, the print controller 120 subsequently waits for a user's selection operation. For this selection operation, the user designates either to cancel the postprocessing and continue the print processing or to change the setting and execute the postprocessing.

Figure 5:
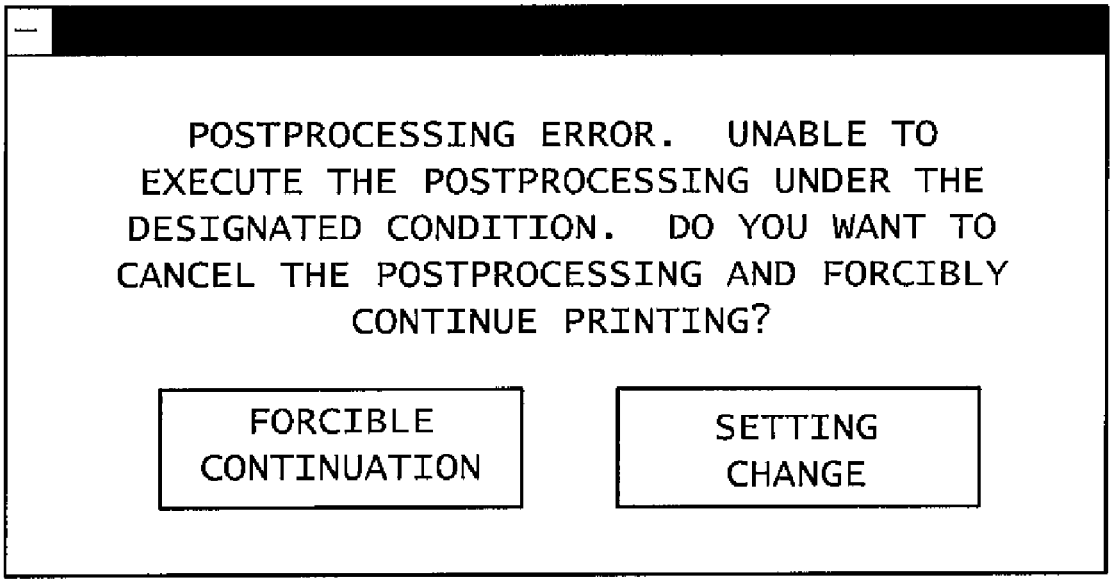
FIG. 5 is a view showing an example of a dialog box displayed on an operation panel when an error occurs.

In this case, as shown in FIG. 5, for instance, the print controller 120 displays, on the operation panel 110, a dialog box including character information saying, for example, "Postprocessing error. Unable to execute the postprocessing under the designated condition. Do you want to cancel the postprocessing to forcibly continue printing?", and also displays operation buttons displaying character information saying, for example, "forcible continuation" and "setting change". At this time, the user can selectively designate the operation that the image forming system should subsequently take, by touching one of the operation buttons.

When the user designates the setting change and not the forcible continuation at Step S28 (No), the print controller 120 goes to the next Step S30. On the other hand, when the user designates the forcible continuation (Yes), the print controller 120 goes to Step S20. Hereinafter, the both cases will be described.

Step S30: When the user designates the setting change and not the forcible continuation (No) at the previous Step S28, the print controller 120 waits until the setting is changed.

The setting change mentioned here means to concretely change the condition setting in order to eliminate a currently occurring error or in order to avoid the occurrence of an error. For example, when the error of the postprocessing is caused by a state of "lack of staples" of the stapler 16, "lack of staples" is solved by the user refilling the stapler 16 with a sufficient number of staples, and consequently the error in the postprocessing is eliminated.

When the error is occurring because the number of sheets exceeds the upper limit number of the staple processing, the number of sheets is decreased to the number equal to or smaller than the upper limit number if, for example, the user changes a print condition from single sided to double sided or changes a print format to so-called 4-in-1 (format to print reduced four-page images on one page), and consequently the error in the postprocessing is also eliminated.

Or, when the error (postprocessing interdiction) is occurring because the staple processing as well as the punching processing is set even though paper of a type not suitable for the staple processing is used in the current job, the condition setting is changed if the user cancels the staple processing or changes the paper type (paper cassette), and consequently, the occurrence of the error is avoided. On the other hand, when the punching processing as well as the staple processing is set for paper of a type not suitable for the punching processing, the occurrence of the error is avoided if the user cancels the punching processing or changes the paper type (paper cassette).

In addition to the above, when the error of the postprocessing is occurring due to a state of "capacity punch chips", the error is eliminated by a user's operation of removing punch chips filling the punch chip collector 122.

In any case, when the user performs some setting change operation as exemplified above (Step S30=Yes), the print controller 120 returns to Step S14 and determines again whether or not the error in the postprocessing is occurring. As a result, if the error is still occurring (Yes), the print controller 120 executes processes at and after Step S24 again. On the other hand, when the error is no longer occurring (No), the print controller 120 goes to Step S22 to continue the print processing.

Step S20: On the other hand, when the user selects and designates the forcible continuation at the previous Step S28 (Yes), the print controller 120 cancels the postprocessing. Consequently, the postprocessing set by the user in the current job is forcibly canceled.

Step S22: After canceling the postprocessing at Step S20, the print controller 120 continues the print processing in this state. In this case, the copies P are discharged in sequence onto, for example, the upper sub tray 40 without undergoing the postprocessing such as the staple processing or the punching processing.

Here, the inventors present preferable concrete examples of the individual set value used in the control processing shown in FIG. 4 as the second example.

(1) Individual Set Value for Each Organization Division

For example, in a case where a plurality of organization divisions commonly use the image forming system in the same company or the like, a general practice in using the image forming system is that each organization division is given a copy card on which an ID code is magnetically recorded in advance and the insertion of the copy card is mandatory for a user to activate the image forming system. In this case, by registering the aforesaid individual set value for each organization division in the storage unit 130 in advance, it is possible for the print controller 120 to identify an organization division from the ID code of the inserted copy card, read the registered individual set value, and execute the control processing. If the operation to be executed when an error occurs is thus decided in advance for each organization division, each user only has to cope with an error according to a manner decided for an organization division to which the user belongs, so that the user can easily cope with the occurrence of the error.

(2) Individual Set Value for Each Print Color Condition

For example, the individual set values can be assigned to respective conditions of full color printing and monochrome printing. In this case, in a job of monochrome printing whose unit printing cost is relatively low, the postprocessing is canceled without generating the postprocessing error and print processing is continued, but in a job of full color printing whose unit printing cost is relatively high, the postprocessing error is generated and a user's intention (forcible continuation or setting change) can be asked every time. Such an individual set value is effective when an image forming apparatus including a color print function is applied to the image forming system.

(3) Individual Set Value for Each Paper Size (Medium Type)

For example, the individual set values are assigned in advance to two classified types of paper size, that is, large and small sizes, and the individual set value can be decided depending on the size of currently used paper. In this case, in a job using small-sized paper whose unit printing cost is relatively low, it is possible to automatically cancel the postprocessing to continue the print processing without generating the postprocessing error, but in a job using relatively large-sized (for example, A3 or larger) paper, it is possible to generate the postprocessing error and ask a user's intention (forcible continuation or setting change) every time. The individual set values may be assigned not only to large-sized paper and small-sized paper but also to paper whose unit cost is high such as an OHP film and thick paper and paper whose unit cost is low such as plain paper.

According to the first example of the control processing shown in FIG. 3, a user side assigns a machine-unique set value to the image forming system in advance, so that it is possible to make the image forming system always operate in the same pattern as is convenient for the user when an error occurs. For example, if stopping the print processing when an error occurs is convenient for the user, the unique set value corresponding to this behavior can be assigned, and it on the other hand, continuing the print processing regardless of the occurrence of an error is convenient for the user, the unique set value corresponding to this behavior can be assigned. In this respect, adopting the first example of the control processing is more convenient for the user compared with a case where only one fixed operation can be taken as a machine when an error occurs.

If, for example, the content putting greater importance to improvement in machine efficiency is set as the unique operation at this time, the system behaves so as to give higher priority to an image forming operation by canceling the setting that the postprocessing should be executed. On the other hand, if the content putting greater importance to convenience of a user is set as the unique operation, the system behaves so as to notify the user of the occurrence of an error in the postprocessing by stopping the image forming operation.

A user (or a manager or the like of the system) can arbitrarily select which content should be set as the unique operation, in advance before using the system. Therefore, if the user thinks that it is beneficial to give higher priority to work efficiency in operating the system, the user can accordingly set the content of the unique operation, and if, on the other hand, the user thinks that it is convenient to stop the operation of the system when an error in the postprocessing occurs, the user can accordingly set the content of the unique operation. Therefore, the system can be operated in pursuit of efficiency as a machine at one time, while at another time, in pursuit of improvement in convenience for a user.

Further, according to the second example of the control processing shown in FIG. 4, by assigning the individual set value, for instance, for each job in advance, a user can decide which operation should be taken in each job when an error occurs. For example, in the current job, if stopping the print processing and reflecting a user's intention each time when an error occurs is convenient, the user can assign the individual set value corresponding to this behavior, and if, on the other hand, continuing the print processing even when an error occurs is convenient for a user, the user can assign the individual set value corresponding to this behavior. Therefore, adopting the second example of the control processing is more convenient for a user compared with a case where only one operation can be always taken as a machine when an error occurs.

As described above, the individual operation of the system can be set in two ways. The content of the first setting is to cancel the setting of the postprocessing and continue the image forming operation when an error occurs. The content of the second setting is to stop the image forming operation to generate an error state and wait for a user's instruction regarding the operation of the system. Therefore, the user can select, for each job, the first setting when a user's intention is to give higher priority to work efficiency, and can select the second setting when, on the other hand, the user's intention is to improve convenience.

Further, selecting the second setting as the individual operation in the system further has the following advantage. That is, from the generated error state, a user can recognize that some error has occurred regarding the postprocessing. After that, a user's designation is asked on whether to give priority to the work by canceling the postprocessing or to change the condition regarding the setting of the postprocessing and execute the postprocessing, which can greatly improve user's convenience.

As described above, it is possible to improve work efficiency of the system or enhance user's convenience, by presetting the operation (behavior) that the system should take when an error regarding the postprocessing occurs. Therefore, the system can realize both work efficiency and usability in a well-balanced manner without sacrificing one of them.

Next, third to fifth examples of the control processing will be described. As described above, simply stopping the operation of the system when an error occurs results in low productivity and deteriorated work efficiency. Nevertheless, if the system continues the print processing without any permission regardless of the postprocessing set by a user, the user cannot immediately understand why the postprocessing set by himself/herself has not been executed, and if the user sticks to his intention to execute the postprocessing, the job has to be executed again from the first, resulting in process return.

Therefore, the system generates the error state to have the user recognize that some error regarding the postprocessing is occurring. Further, because of the error state, the user reconsiders the setting regarding the postprocessing and performs the setting change operation, and if as a result, the error is solved, the system automatically resumes the image forming operation at an instant when the error is solved. In this case, the user can surely recognize that his/her own operation was appropriate, which can make the user feel relieved and assured. Hereinafter, the third example will be concretely described.

THIRD EXAMPLE

Figure 6:
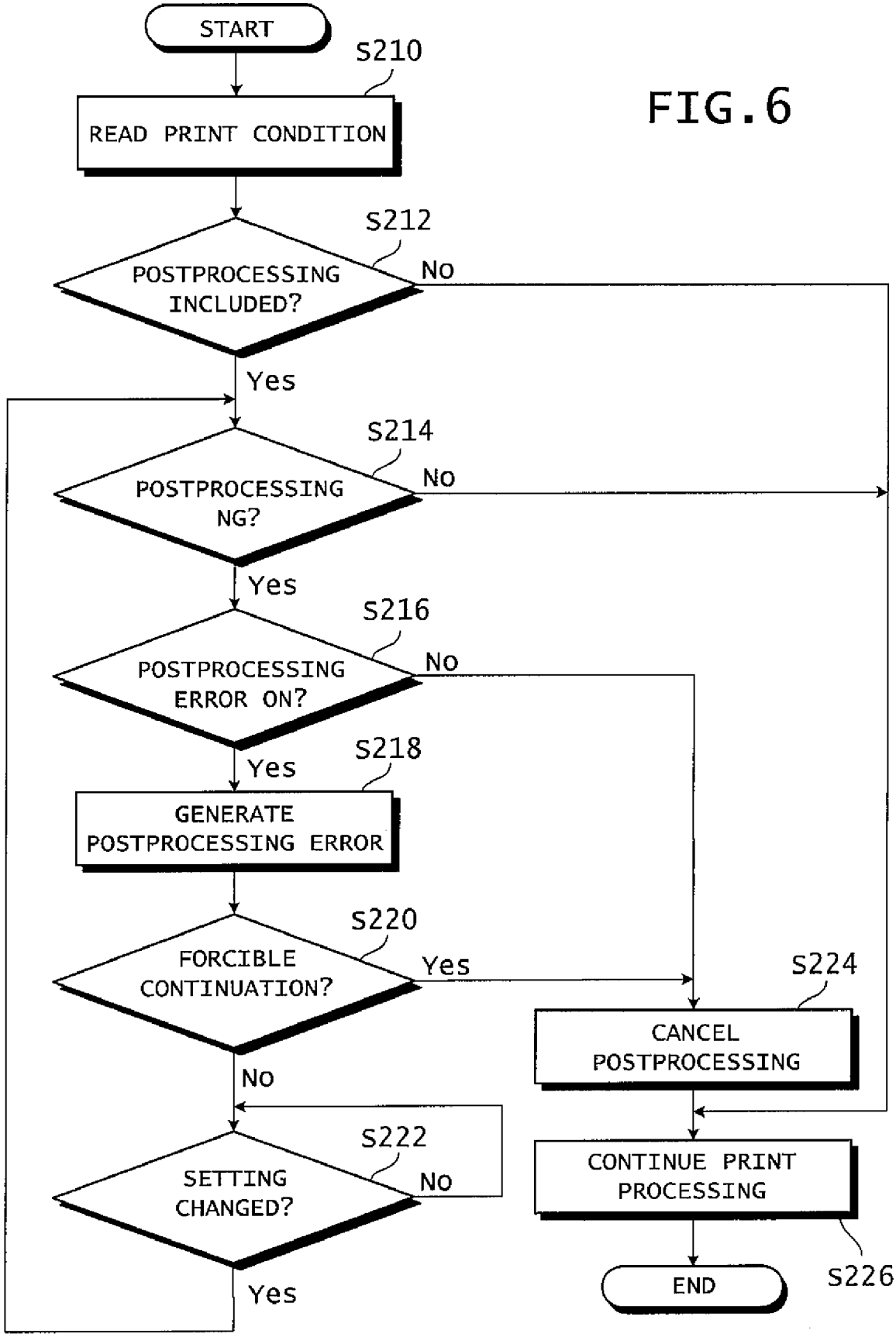
FIG. 6 is a flowchart showing a third example of the control processing executed by the print controller.

FIG. 6 is a flowchart showing the third example of the control processing executed by the print controller 120. After completing the image forming processing (drawing), the print controller 120 subsequently executes the control processing in FIG. 6 as the third example. Hereinafter, the concrete procedure will be described in order of events.

Step S210: The print controller 120 reads, from the storage unit 130, a print condition set for a current job. As described above, the print condition is decided based on the contents that a user sets for each job via the operation panel 110 and is stored in the storage unit 130.

Step S212: Next, the print controller 120 determines whether or not the read print condition includes the setting regarding the postprocessing. Concretely, the print controller 120 determines whether or not the print condition includes the setting of the postprocessing such as the aforesaid staple processing or punching processing. If no special setting regarding the postprocessing is included (No), the print controller 120 continues the print processing (Step S226 in FIG. 6) and once finishes the control processing here. On the other hand, when the setting regarding the postprocessing is included (Yes), the print controller 120 goes to the next Step S214.

Step S214: The print controller 120 determines whether or not an error (NG) regarding the postprocessing is occurring in the current job. Concretely, the print controller 120 determines whether or not any of the aforesaid various errors is occurring in the current job. When it is determined as a result that no special error is occurring (No), the print controller 120 continues the print processing (Step S226 in FIG. 6) and once finishes the control processing. On the other hand, when some error is occurring (Yes), the print controller 120 goes to the next Step S216.

Step S216: The print controller 120 confirms whether or not it is set that a postprocessing error should be generated. As a default value, the system is set to generate an error state when an error regarding the postprocessing occurs (a default value is ON). This default value is stored in, for example, the storage unit 130 and does not change unless any special setting change operation is performed. Therefore, when confirming at Step S218 whether or not it is set that the postprocessing error should be generated (default), the print controller 120 normally goes to the next Step S218.

Step S218: The print controller 120 generates the postprocessing error based on the default of the image forming system. Accordingly, the print controller 120 stops the operation of the image forming system. After generating the postprocessing error, the print controller 120, for instance, causes character information such as an error message to be displayed on the operation panel 110 or causes error warning sound to be outputted. Consequently, the image forming system becomes in the error state, and this state is recognizable by a user.

Step S220: After generating the postprocessing error, the print controller 120 subsequently waits for a user's selection operation. For this selection operation, the user designates either to cancel the postprocessing and continue the print processing or to change the setting and execute the postprocessing.

In this case, as shown in FIG. 5, for instance, the print controller 120 displays, on the operation panel 110, a dialog box including character information saying, for example, "Postprocessing error. Unable to execute the postprocessing under the designated condition. Do you want to cancel the postprocessing to forcibly continue printing?", and also displays operation buttons displaying character information saying, for example, "forcible continuation" and "setting change". At this time, the user can selectively designate the operation that the image forming system should subsequently take, by touching one of the operation buttons.

When the user designates the setting change and not the forcible continuation at Step S220 (No), the print controller 120 goes to the next Step S222. On the other hand, when the user designates the forcible continuation (Yes), the print controller 120 goes to Step S224. Hereinafter, the both cases will be described.

Step S222: When the user designates the setting change and not the forcible continuation (No) at the previous Step S220, the print controller 120 waits until the setting is changed.

The setting change mentioned here means to concretely change the condition setting in order to eliminate a currently occurring error or in order to avoid the occurrence of an error. For example, when the error of the postprocessing is caused by a state of "lack of staples" of the stapler 16, "lack of staples" is solved by the user refilling the stapler 16 with a sufficient number of staples, and therefore, the error in the postprocessing can be eliminated.

Or, when the error (postprocessing interdiction) is occurring because the staple processing as well as the punching processing is set even though paper of the type not suitable for the staple processing is used in the current job, the condition setting is changed if the user cancels the staple processing or changes the paper type (paper cassette), and consequently, the occurrence of the error is avoided. On the other hand, when the punching processing as well as the staple processing is set for paper of a type not suitable for the punching processing, the occurrence of the error is avoided if the user cancels the punching processing or changes the paper type (paper cassette).

In addition to the above, when the error of the postprocessing is occurring due to a state of "capacity punch chips", the error is eliminated by a user's operation of removing punch chips filling the punch chip collector 122.

In any case, when the user performs some setting change operation as exemplified above (Step S222=Yes), the print controller 120 returns to Step S214 and determines again whether or not the error in the postprocessing is occurring. As a result, if the error is still occurring (Yes), the print controller 120 executes processes at and after Step S216 again.

On the other hand, when the re-determination by the print controller 120 on whether or not the error in the postprocessing is occurring shows that the error is no longer occurring (No) because the user changes the setting, the print controller 120 goes to Step S226 to continue the print processing. In this case, the postprocessing error state is canceled and the job involving the postprocessing is automatically executed.

The image forming system thus automatically starts (resumes) the execution of the job when the error in the postprocessing is eliminated as a result of the setting change made by the user, so that the user can recognize (realize) that the setting change operation performed by himself/herself is appropriate, which can make the user feel assured and relieved. Further, the image forming system can surely execute the postprocessing set by the user, which accordingly can improve usability.

Further, at the time of the error occurrence, the user's intention is confirmed after the image forming system becomes in the error state, which prevents the system from canceling the postprocessing and continuing only the print processing without permission. Therefore, the user does not feel odd or does not wonder why the postprocessing has not been executed, and process return or the like does not occur.

Step S224: On the other hand, when the user selects and designates the forcible continuation at the previous Step S220 (Yes), the print controller 120 cancels the postprocessing. Consequently, the postprocessing set by the user in the current job is forcibly canceled.

Step S226: After canceling the postprocessing at Step S224, the print controller 120 continues the print processing in this state. In this case, the postprocessing such as the staple processing or the punching processing is not executed and the copies P are discharged in sequence to, for example, the upper sub tray 40. Even if the postprocessing is thus forcibly canceled, the user does not feel odd or does not wonder why, because the forcible cancellation correctly reflects the user's intention.

As described above, the system gives an occasion for a user to reconsider the setting when an error regarding the postprocessing occurs, which can enhance convenience for a user. Further, since the postprocessing is not canceled against a user's request, work efficiency is not deteriorated.

FOURTH EXAMPLE

Figure 7:
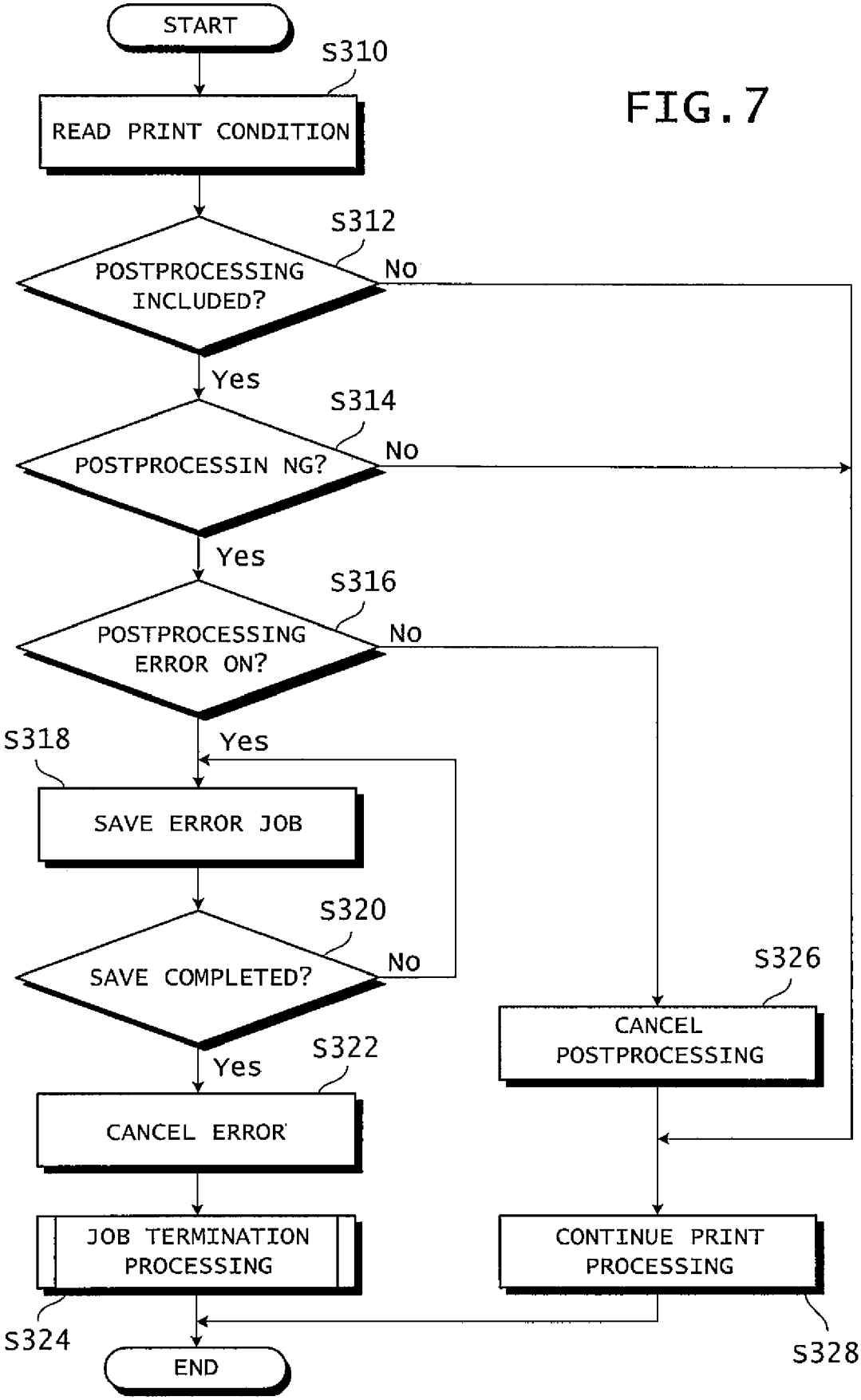
FIG. 7 is a flowchart showing a fourth example of the control processing executed by the print controller.

FIG. 7 is a flowchart showing the fourth example of the control processing executed by the print controller 120. After completing the image forming processing (drawing), the print controller 120 subsequently executes the control processing in FIG. 7 as the fourth example. Hereinafter, the concrete procedure will be described in order of events.

Step S310: The print controller 120 reads, from the storage unit 130, a print condition set for a current job. As described above, the print condition is decided based on the contents that a user sets for each job via the operation panel 110 and is stored in the storage unit 130.

Step S312: Next, the print controller 120 determines whether or not the read print condition includes the setting regarding the postprocessing. Concretely, the print controller 120 determines whether or not the print condition includes the setting of the postprocessing such as the aforesaid staple processing or punching processing. When no special setting regarding the postprocessing is included (No), the print controller 120 continues the print processing (Step S328 in FIG. 7) and once finishes the control processing here. On the other hand, when the setting regarding the postprocessing is included (Yes), the print controller 120 goes to the next Step 314.

Step S314: The print controller 120 determines whether or not an error (NG) regarding the postprocessing is occurring in the current job. Concretely, the print controller 120 determines whether or not any of the aforesaid various errors is occurring in the current job. When it is determined as a result that no special error is occurring (No), the print controller 120 continues the printing processing (Step S328 in FIG. 7) and once finishes the control processing. On the other hand, when some error is occurring (Yes), the print controller 120 goes to the next Step S316.

Step S316: The print controller 120 determines whether or not a set value unique to the image forming system (unique set value) indicates that a postprocessing error should be generated. The unique set value mentioned here means a unique value representing what operation (behavior) the image forming system should take when an error regarding the postprocessing occurs. Such a unique set value is stored in the storage unit 130 of the copier 2 in advance, and the unique set value read from the storage unit 130 serves as a basis of the determination at Step S316 by the print controller 120.

There are mainly two unique set values, for instance. The first one is a set value corresponding to a series of operations of stopping the operation of the image forming system to generate a postprocessing error and saving the content of an error job in a later readable state (represented by ON in binary) when an error regarding the postprocessing occurs. The second one is a set value corresponding to a series of operations of automatically canceling the postprocessing and continuing the print processing without generating the postprocessing error (represented by OFF) when an error occurs. When the image forming system has the former first unique set value (=ON) (Step S316=Yes), the print controller 120 goes to the next Step S318. On the other hand, when the image forming system has the latter second unique set value (=OFF) (Step S316=No), the print controller 120 goes to another Step S326 and then to Step S328. Hereinafter, these steps will be described.

First, in the case where the system has the second unique set value, the following processes are executed. P Step S326: The print controller 120 automatically cancels the postprocessing based on the unique set value of the image forming system. Consequently, the postprocessing set by the user in the current job is canceled.

Step S328: After canceling the postprocessing at Step S326, the print controller 120 continues the print processing in this state. In this case, the postprocessing such as the staple processing or the punching processing is not executed, and the copies P are discharged in sequence to, for example, the upper sub tray 40.

On the other hand, when the system has the first unique set value, the following processes are executed.

Step S318: The print controller 120 generates the postprocessing error based on the unique set value of the image forming system. Accordingly, the print controller 120 stops the operation of the image forming system. Further, after generating the postprocessing error, the print controller 120 saves information regarding the job corresponding to this error in a hard disk of the storage unit 130. Consequently, the contents of the current job are transferred from the temporary memory area (RAM) to a saving area from which the content is later readable.

Step S320: After confirming that the information regarding the error job has been saved in the hard disk (write operation) as described above, the print controller 120 goes to the next Step S322.

Step S322: After confirming that the saving in the hard disk has been completed, the print controller 120 cancels the postprocessing error.

Step S324: Next, the print controller 120 executes job termination processing to finish the control processing there. In the job termination processing, for example, the contents temporarily stored in the RAM of the storage unit 130 in the current job are erased. Consequently, the current job itself is canceled as a print job. Therefore, in a case where a new job by, for example, another user (or the same user) is subsequently executed, the print controller 120 writes the contents of the subsequent job in the cleared memory area of the RAM, and can shift to new image processing and its print operation. Incidentally, at this time, the operation panel 110 displays information regarding the termination of the error job. The concrete display content will be described later with reference to another drawing.

Figure 8:
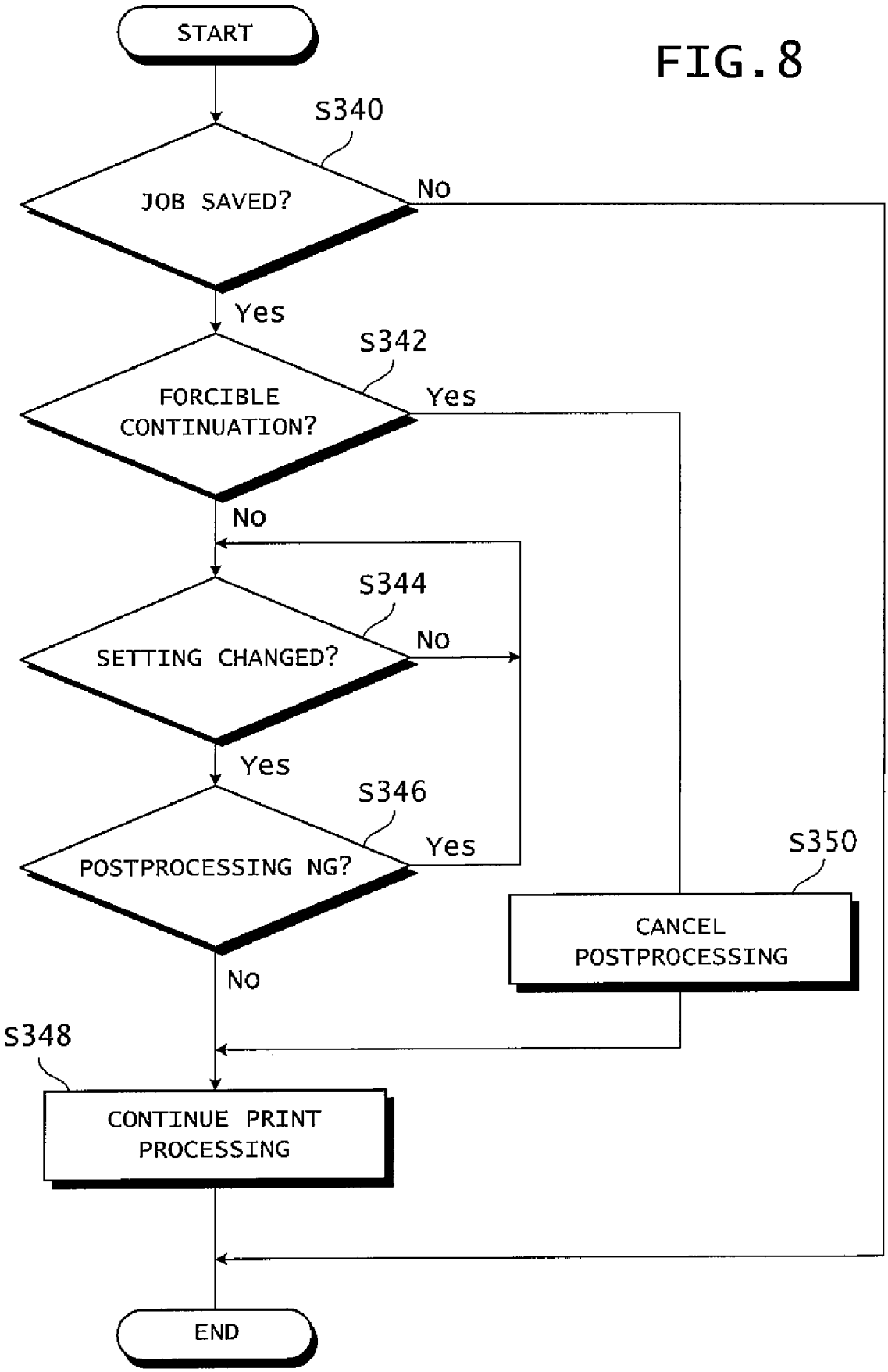
FIG. 8 is a flowchart showing job continuation processing executed after an error is generated in the control processing.

FIG. 8 is a flowchart showing job continuation processing executed after the postprocessing error is generated in the previous control processing. After executing Step S318 to Step S324 in the control processing to finish the control processing, the print controller 120 subsequently executes the job continuation processing in FIG. 8. Hereinafter, the concrete procedure will be described.

Step S340: The print controller 120 confirms whether or not the information regarding the error job is saved in the hard disk of the storage unit 130. At this instant, since the information on the error job saved in the previous control processing exists (Yes), the print controller 120 goes to the next Step S342.

Step S342: The print controller 120 waits for a user's selection operation. Here, for the selection operation, the operation panel 110 is used. To perform the selection operation, the user selects the error job saved in the hard disk and designates whether to cancel the postprocessing regarding this job and continue the print processing or to change the setting and execute the postprocessing.

Figure 9:
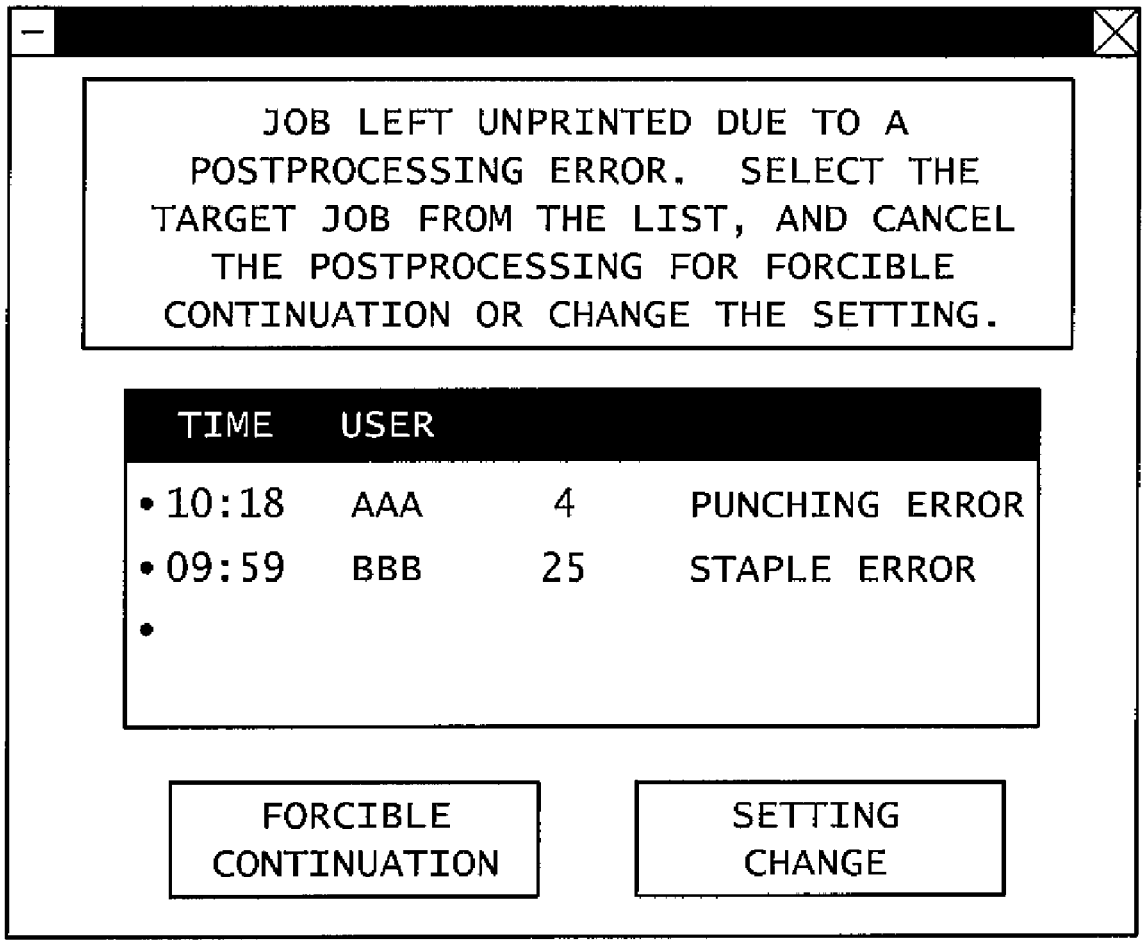
FIG. 9 is a view showing an example of a dialog box displayed on the operation panel when an error occurs and a job is saved.

In this case, for example, as shown in FIG. 9, the print controller 120 displays on the display panel 110, for example, a list of jobs saved in the hard disk. The job list includes information such as the time when each job is executed, the name of a user executing the job, the number of pages included in the job (copy number), and the content of an error. Besides, information such as the name of each job and date may be added as the error information. In any case, in response to, for example, a user's touching of a display portion of the job selected from the list display, the display of the selected job is reversed (white background→black background).

Further, at this time, the print controller 120 displays on the operation panel 110 a dialog box including character information saying, for example, "Job left unprinted due to a postprocessing error. Select the target job from the list, and cancel the postprocessing for forcible continuation or change the setting." Then, when the user selects the job as described above, the display of operation buttons displaying character information saying, for example, "forcible continuation" and "setting change" is made effective, so that the user can actually perform a touch operation to either of the buttons. By touching one of the operation buttons at this time, the user can selectively designate an operation that the image forming system should subsequently take.

When the user designates the setting change but not the forcible continuation at Step S342 (No), the print controller 120 goes to the next Step S344. On the other hand, when the user designates the forcible continuation (Yes), the print controller 120 goes to Step S350. The both cases will be hereinafter described.

Step S344: When the user designates the setting change and not the forcible continuation (No) at the previous Step S342, the print controller 120 waits until the setting is changed.

The setting change mentioned here means to concretely change the condition setting in order to eliminate a currently occurring error or in order to avoid the occurrence of an error. For example, when the error of the postprocessing is caused by a state of "lack of staples" of the stapler 16, "lack of staples" is solved by the user refilling the stapler 16 with a sufficient number of staples, and therefore, the error in the postprocessing can be consequently eliminated.

Or, when the error (postprocessing interdiction) is occurring because the staple processing as well as the punching processing is set even though paper of a type not suitable for the staple processing is used in the current job, the condition setting is changed if the user cancels the staple processing or changes the paper type (paper cassette), and consequently, the occurrence of the error is avoided. On the other hand, when the punching processing as well as the staple processing is set for paper of a type not suitable for the punching processing, the occurrence of the error is avoided if the user cancels the punching processing or changes the paper type (paper cassette).

In addition to the above, when the error of the postprocessing is occurring due to a state of "capacity punch chips", the error is eliminated by a user's operation of removing punch chips filling the punch chip collector 122.

In any case, when the user performs some setting change operation as exemplified above (Step S344=Yes), the print controller 120 goes to the next Step S346.

Step S346: After the user performs the setting change operation, the print controller 120 determines whether or not the error in the postprocessing is occurring. When it is determined as a result that the error is still occurring (Yes), the print controller 120 returns to Step S344 to wait for the setting change operation again. On the other hand, when the error is no longer occurring (No), the print controller 120 goes to Step S348 to continue the print processing.

Step S350: On the other hand, when the user selects and designates the forcible continuation at the previous Step S342 (Yes), the print controller 120 cancels the postprocessing. Consequently, the postprocessing set by the user in the current job is forcibly canceled.

Step S348: After canceling the postprocessing at Step S350, the print controller 120 continues the print processing in this state. In this case, the copies P are discharged in sequence onto, for example, the upper sub tray 40 without undergoing the postprocessing such as the staple processing or the punching processing.

According to the fourth example of the control processing described above, a user side assigns a machine-unique set value to the image forming system, so that it is possible to make the image forming system always operate in the same pattern as is convenient for the user when an error occurs. For example, if stopping the print processing and saving the contents of the job when an error occurs is convenient for the user, the unique set value corresponding to this behavior can be assigned, and if, on the other hand, continuing and completing the print processing regardless of the occurrence of an error is convenient for the user, the unique set value corresponding to this behavior can be assigned. In this respect, adopting the fourth example of the control processing is more convenient for the user compared with a case where only one fixed operation can be taken as a machine when an error occurs.

In addition, in this system, the user can later confirm the job corresponding to the postprocessing error and can select whether to automatically cancel the postprocessing and forcibly continue the print processing or to change the setting and execute the postprocessing, and therefore, convenience for a user is further improved.

Further, in this system, even in a case where another designated job follows the job corresponding to the postprocessing error, it is possible to temporarily transfer the contents of the job corresponding to the postprocessing error to the hard disk and then execute the next job. Therefore, an error of a job does not become a cause of stagnating the execution of a subsequent job, which is advantageous in that work efficiency as the whole machine is not deteriorated.

EXAMPLE 5

Figure 10:
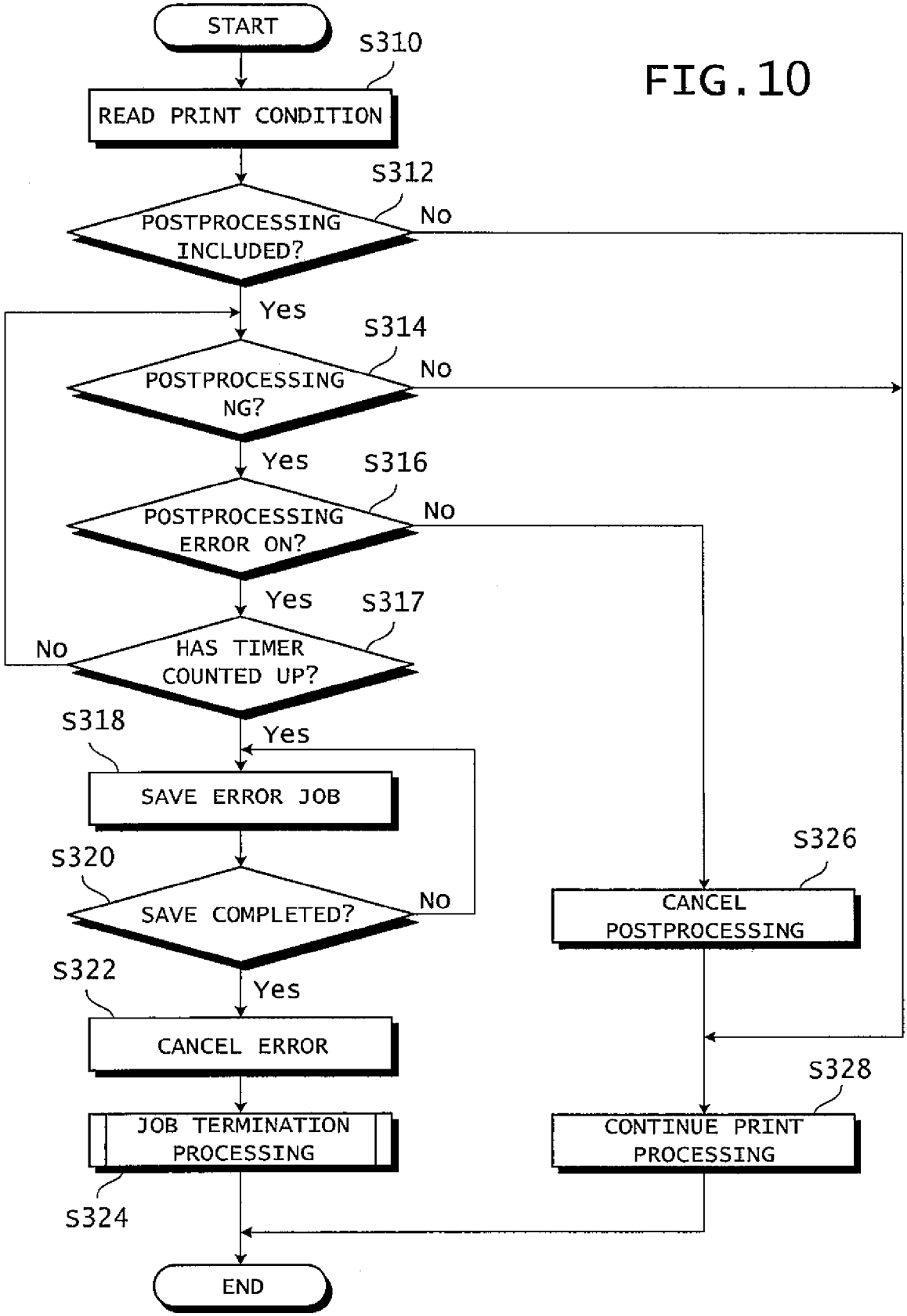
FIG. 10 is a flowchart showing a fifth example of the control processing executed by the print controller.

Next, FIG. 10 is a flowchart showing the fifth example of the control processing executed by the print controller 120. After completing the image forming processing (drawing), the print controller 120 can also subsequently execute the control processing in FIG. 10 as the fifth example. Processes at Step S310 to Step S316 and Step S318 to Step S328 in FIG. 10 are the same as those in the fourth example previously described, and therefore only what are different will be described below.

Step S317: In the control processing of the fifth example, when it is determined at Step S314 that an error regarding the postprocessing is occurring and the unique set value representing the generation of an error state is given to the system (Step S316=Yes), the postprocessing error is not immediately generated but a preset designated time (for example, its settable range is about 10 seconds to about 60 seconds) is counted by a timer.

The print controller 120 returns from Step S317 to Step S314 during a period until the timer counts up (No) and continues to confirm whether or not the error is occurring. When the user detects the error (for example, lack of staples, capacity punch chips, or the like) to eliminate the error during this period, the print controller 120 determines at Step S314 that the error in the postprocessing is eliminated (No). In this case, the print controller 120 goes to Step S328 and is able to continue the print processing in this state.

On the other hand, when the error is not eliminated by the time when the timer counts up (Step S317=Yes), the print controller 120 goes to the next Step S318 and generates the postprocessing error there for the first time.

According to the above-described fifth example of the control processing, even when an error in the postprocessing occurs, the system is kept in the standby state until the designated time has passed, without proceeding to the next operation (the error generation, the job saving operation). Therefore, the designated time can give a user the time for noticing the occurrence of the error, and if the user eliminates the error during this period, the print operation can be immediately continued, which makes it possible to improve productivity as a machine in addition to convenience of the user.

By once saving image data processed in a job in which the execution of the postprocessing is set as described above, it is possible to read the image data later when necessary and ask a user's intention on whether to cancel the postprocessing and continue the print processing or to change the setting regarding the postprocessing.

In this case, the system does not keep stopping its operation in the error state for a long time due to an error occurring in one job, and it is possible to once transfer the information on the error job and then execute another job. Therefore, productivity as the image forming system is not deteriorated, and the information regarding the error job is not erased and can thus be used later, which can improve convenience for a user.

As described above, when an error regarding the postprocessing occurs, the system once saves the image data used in the job and the setting regarding the postprocessing, so that the processing of the image data and the setting operation performed previously do not become in vain and can be effectively used later.

Further, since the system does not keep stopping its operation for a long time even when an error regarding the postprocessing occurs, productivity as the whole system is not deteriorated and the postprocessing is not canceled against a user's request, and therefore, work efficiency of an individual user is not worsened.

Incidentally, in the control processing (the fourth example or the fifth example), when the error job is saved in the hard disk (Step S318), a process of outputting an error page or outputting error sound may be added. In this case, when a user comes to get the outputted paper, the user can be notified that the contents of the error job are saved in the hard disk.

The image forming system is not limited to the above-described forms. The finisher 4 may include a mechanism which, at the time of the staple processing, shifts the copies P on the intermediate tray in a direction crossing the paper conveyance path (for example, a far side direction for a user) and applies the staple processing to the copies P after aligning the copies P at a predetermined stapling position. In this case, in a job in which the staple processing is set, if paper size not suitable for the shift operation (postcard size and the like) is used, the shift is forbidden (interdicted), and an error of the postprocessing occurs.

The above-described various errors in the postprocessing which are likely to occur in the system are only examples, and if a different error is anticipated in a system with a different structure, the first example to the fifth example of the control processing can be executed so as to be adapted to the error.

Besides, the various members and driving components described in the above-described forms are all preferable examples and may be appropriately modified for implementation.

Next, an embodiment of an image forming apparatus will be described.

Figure 11:
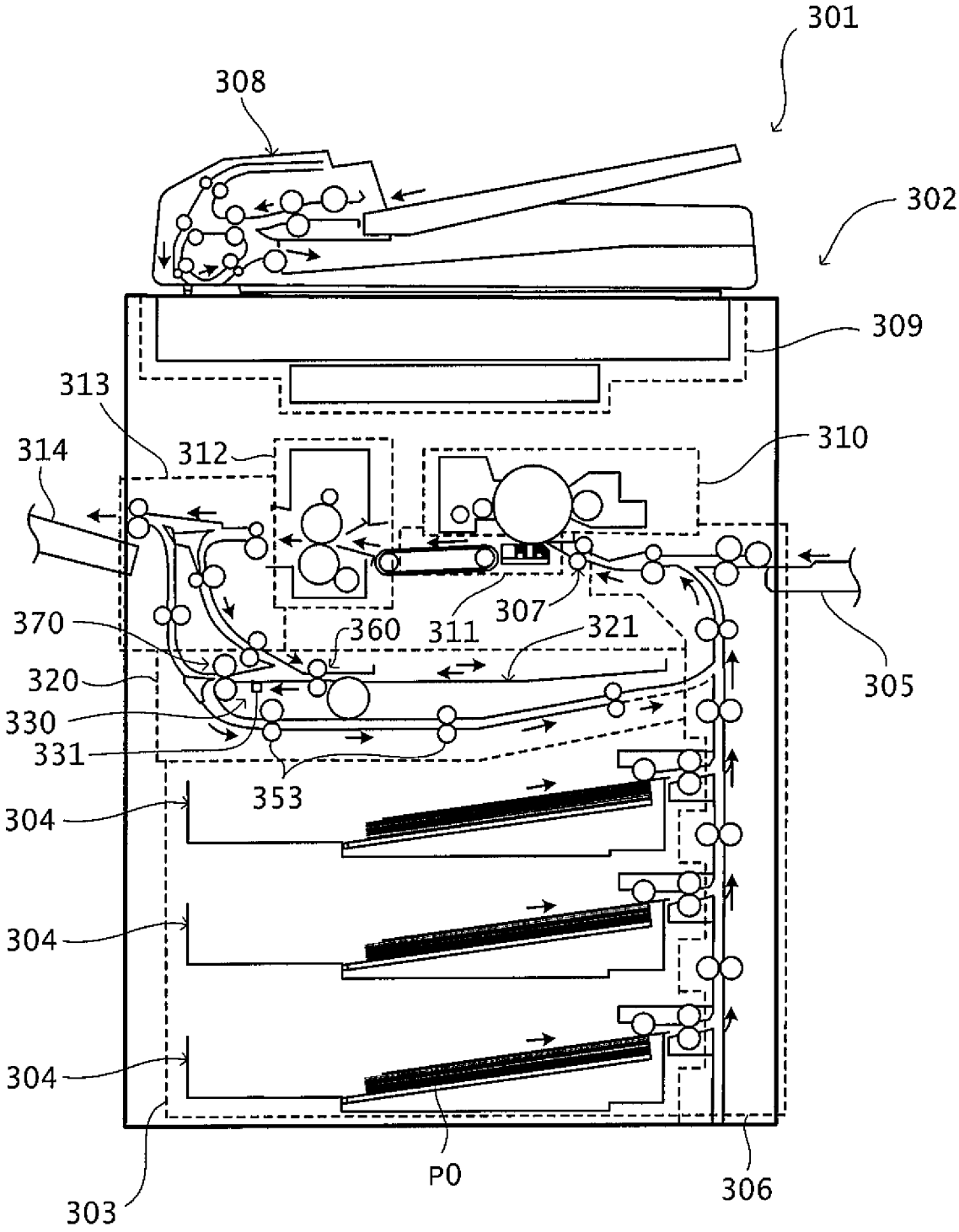
FIG. 11 is a view schematically showing a copier.

FIG. 11 is a vertical front cross sectional view schematically showing a copier 301. The solid-line arrows in FIG. 11 show paper conveyance routes and conveyance directions thereof. The copier 301 is used in a stand-alone state or is used as part of the above-described image forming system.

As shown in FIG. 11, in a lower portion of a main body 302 of the copier 301, a cassette-type paper feeder 303 is disposed. The paper feeder 303 includes three tiers of paper feeding cassettes 304. The paper feeding cassettes 304 are of a so-called front loading type, and each of the paper feeding cassettes 304 can be slidingly drawn to a front side (near side in FIG. 11) relative to the main body 302. Further, papers P0 such as cut papers not yet undergoing printing are contained in each of the paper feeding cassettes 304. From the cassette-type paper feeder 303, the papers P0 loaded in the paper feeding cassettes 304 are separately sent out sheet by sheet.

For the upper, middle, and lower paper feeding cassettes 304, paper sizes and paper types different depending on the respective positions can be set. For example, the uppermost paper feeding cassette 304 can be for a multi-purpose use and can contain OHP sheets, thick papers, thin papers, and so on. The middle paper feeding cassette 304 can contain A4 plain papers whose use frequency is relatively high, and the lowest paper feeding cassette 304 can contain papers larger than A4. The size, type, and so on of papers to be contained in each of the paper feeding cassettes 304 can be set in advance in the copier 301.

On an upper portion of a right side surface of the main body 302, a manual paper feeder 305 is provided to protrude rightward. In the manual paper feeder 305, a paper P0 of a size not contained in the cassette-type paper feeder 303 or a paper to be fed sheet by sheet such as an OHP sheet is placed. Incidentally, the manual paper feeder 305 may be of a type that can be put on the right side surface of the main body 30 in a folded state.

The copier 301 includes therein a conveyor part 306. Relative to the cassette-type paper feeder 303, the conveyor part 306 is positioned on the right, which is a paper feeding direction of the cassette-type paper feeder 303, and relative to the manual paper feeder 305, the conveyor part 306 is positioned on the left. The conveyor part 306 conveys the paper PO sent out from the cassette-type paper feeder 303, in a vertically upward direction along the side surface of the main body 302, or horizontally conveys the paper P0 sent out from the manual paper feeder 305, and these papers P0 reach a transfer part 311.

On an upper surface of the main body 302 of the copier 301, an ASP 308 is installed. Further, in an upper portion of the main body 302, an optical part 309 is provided at a position under the ASF 308. To copy an original, a user sets, on the ASP 308, the original on which an image such as characters, graphics, or a pattern is drawn. If a plurality of originals are set, the ASP 308 separately feeds the originals sheet by sheet, and the optical part 309 reads images drawn thereon.

In the main body 302, a print engine 310 as an image forming part and the transfer part 311 are provided at a downstream position when seen in the direction of paper conveyance from the conveyor part 306. Out of these, in the print engine 310, an electrostatic latent image of the original image is formed based on image data resulting from the processing of the read image, and from the electrostatic latent image, a toner image is formed.

A resist roller 307 is provided at a position that is on the paper conveyance direction downstream side of the conveyor part 306 and is on an immediate upstream side of the transfer part 311. The resist roller 307 corrects oblique feeding of the paper P0 and also sends out the paper P0 toward the transfer part 311, while taking synchronization with the toner image formed in the print engine 310. In the transfer part 311, the toner image is transferred to the paper P0 which is sent from the resist roller 307 in synchronization with the toner image.

On the paper conveyance direction downstream side of the transfer part 311, a fuser part 312 is provided. The paper P0 bearing the unfixed toner image transferred thereto in the transfer part 311 is sent to the fuser part 312, where the toner image is heated and pressed to be fixed.

Further, a discharge/branch part 313 is provided at a position that is on the paper conveyance direction downstream side of the fuser part 312 and is near a left side surface of the main body 302. In a case where double-sided printing is not performed (in a case of single-sided printing), the paper P0 discharged from the fuser part 312 is directly discharged to a paper receiving tray 314 from the discharge/branch part 313.

A double-sided printing unit (double-sided printing mechanism) 320 is provided at a position that is below an area extending from the print engine 310 to the discharge/branch part 313 and is above the cassette-type paper feeder 303. For double-sided printing, the paper P0 discharged from the fuser part 312 passes through the discharge/branch part 313 to be sent to the double-sided printing unit 320. The paper P0 sent to the double-sided printing unit 320 is then changed in its conveyance direction by a paper reversing device 330 included in the double-sided printing unit 320, and is sent again from here to the transfer part 311 via the conveyor part 306 and the resist roller 307.

The paper reversing device 330 includes a switchback mechanism 360 and a shift mechanism 370. The switchback mechanism 360 reverses the conveyance direction of the paper P0. The shift mechanism 370 corrects widthwise displacement of the paper P0. A sensor 331 for detecting the widthwise displacement of the paper P0 is provided on the paper conveyance direction upstream side of the shift mechanism 370.

An intermediate tray 321 is disposed on a further downstream side of the switchback mechanism 360 when seen in the entrance direction to the paper reversing device 330. This intermediate tray 321 is temporarily loaded with the paper P0 having a printed surface on one side. The switchback mechanism 360 once loads the paper P0 on the intermediate tray 321 and thereafter switches back the paper P0 for change of its conveyance direction.

The switched back paper P0 is position-corrected by the shift mechanism 370 and at the conveyance direction downstream side of the shift mechanism 370, the paper P0 is thereafter moved downward to be reversed. Then, after being sent rightward by a plurality of conveyor rollers 353 under the transfer part 311 and the print engine (image forming part) 310, the paper P0 moves slightly obliquely upward to join the conveyor part 306. Consequently, the paper P0 is sent to the print engine 310 with its previously printed surface facing downward, and printing is performed on the both surfaces of the paper P0. The paper P0 having undergone the double-sided printing is discharged to the paper receiving tray 314 via the discharge/branch part 313. Alternatively, after being reversed by the paper reversing device 330 again, the paper P0 is conveyed upward along the left side portion of the main body 302 to be discharged to the paper receiving tray 314.

Figure 12:
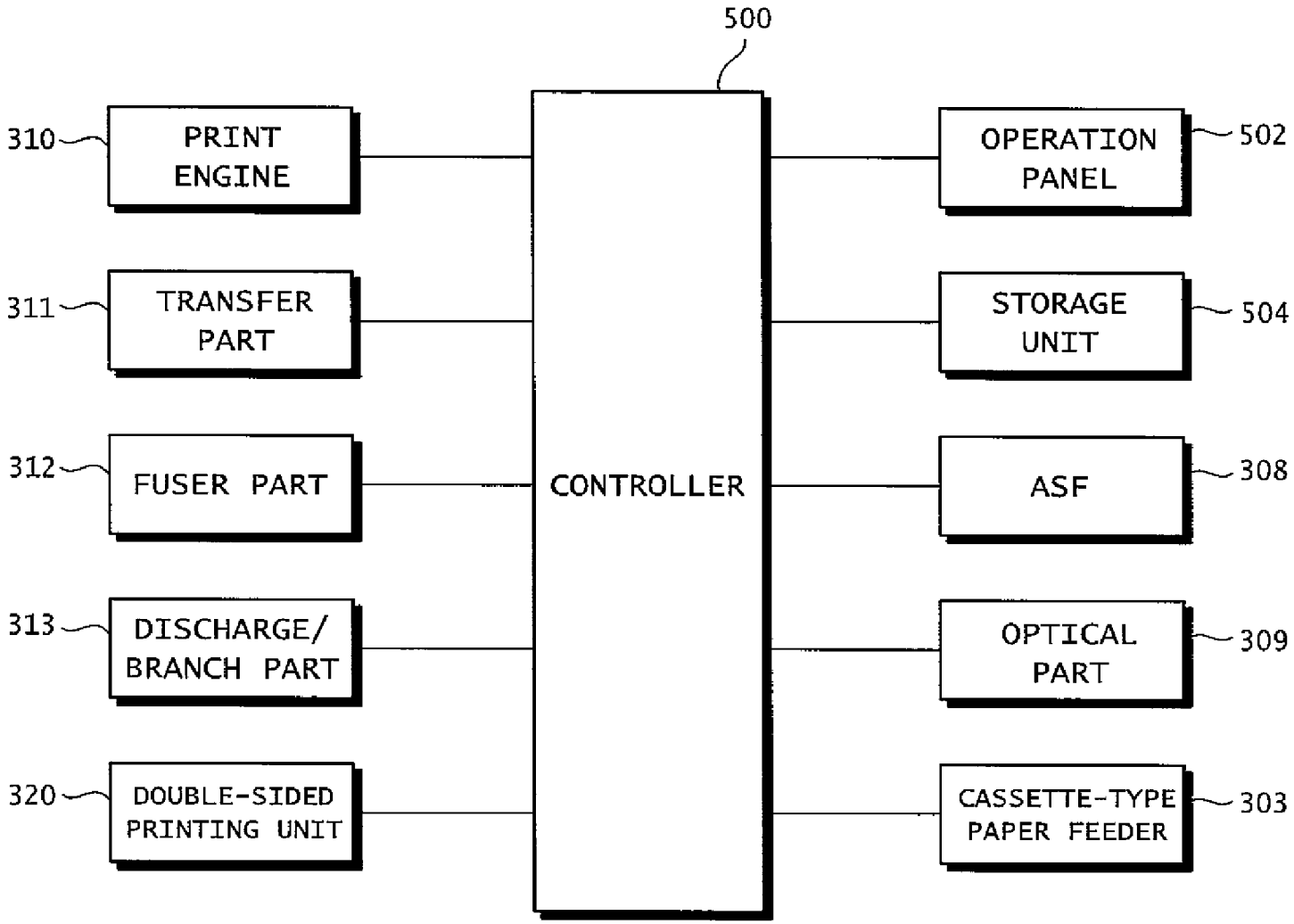
FIG. 12 is a block diagram schematically showing the structure regarding the control in the copier.

FIG. 12 is a block diagram schematically showing the structure regarding the control in the copier 301. The copier 301 includes a controller 500 controlling the operation of the copier 301. The controller 500 is constituted of, for example, an electric circuit including a central processing unit (CPU), and this electric circuit, which is formed on a circuit board, is built in the copier 301.

The above-described original feeding operation by the ASF 308, and the image read operation in the optical part 309, paper feeding operation from the paper feeder 303, and so on which follow the original feeding operation are controlled by the controller 500. Further, the image forming by the print engine 310 and the operations of the transfer part 311, the fuser part 312, the discharge/branch part 313, and the double-sided printing unit 320 described above are all controlled by the controller 500.

As shown in FIG. 12, an operation panel 502 and a storage unit 504 are connected to the controller 500. On an upper surface of the main body 302, the operation panel 502, though not shown in FIG. 11, is provided at a near side position of the ASF 308 when seen from a user. The operation panel 502 has a touch panel as well as operation keys, and is capable of receiving not only operations to the operation keys but also a touch operation by a user, via a display screen. Further, the storage unit 504 has, for example, a storage device (ROM, RAM), a large-capacity storage device (hard disk), and so on, and an image read in the optical part 309 is temporarily stored in the storage unit 504 in a predetermined data format.

In the copier 301, for example, data set for each job through the operation to the operation panel 502 is stored in the storage unit 504 via the controller 500. This setting includes paper size, paper type, paper feeding direction, a printing manner such as double-sided or single-sided, copy density, frame erase, binding margins, 4-in-1 integration, and so on, and the controller 500 executes image processing according to each setting. The time taken for the copier 301 to execute the image processing depends on the contents of this setting. In the storage unit 504, for example, a copier application program for multithreaded processing is stored.

For example, in image processing involving the copying of originals, when a user sets the originals on the ASF 308 and presses a start key (not shown) of the operation panel 502, the following processing is executed in response to this operation. First, in a case where a paper sensor (not shown) installed in the ASF 308 detects the originals, the ASF 308 feeds the originals sheet by sheet and the optical part 309 scans images of the originals in the course of the feeding. Image data read at this time are stored in the storage unit 504 via the controller 500 in a unit of one job.

After performing preprocessing such as image noise filtering on the image data, the controller 500 performs the image processing according to the settings of various kinds to supply the processed data to the print engine 310 page by page. Consequently, an electrostatic latent image is formed on a surface of a photosensitive drum of the print engine 310, and the electrostatic latent image is developed with a toner.

Meanwhile, inside the copier 301, a paper taken out from the cassette-type paper feeder 303 is fed to the resist roller 307 and is tentatively stopped here. When the photosensitive drum of the print engine 310 rotates to reach a predetermined angle, the paper is conveyed again by the resist roller 307 at this timing. Consequently, the toner image is transferred to the paper.

In a case where double-sided printing is set in a current job, after the paper bearing the transferred toner image passes through the fuser part 312 to be heated and pressed here, the conveyance direction of the paper branches downward in the discharge/branch part 313, so that the paper is sent out toward the double-sided printing unit 320.

In addition to the above basic operations of the copier 301, the copier 301 performs the following plural operations in a case where the controller 500 determines that the double-sided printing cannot be executed even though a user designates the double-sided printing in the current job.

First, a description will be given of examples where a user designates double-sided printing but the controller 500 determines that the double-sided printing is inexecutable. Here, the double-sided printing is determined as inexecutable mainly due to paper size or paper type used in the job.

(1) In a case where a paper feed shelf (paper feed cassette 304) is designated in the job, if the size or type of papers contained in the designated paper feed shelf (paper feed cassette 304) is incompatible to the double-sided printing, the controller 500 determines that the double-sided printing is inexecutable even though the double-sided printing is designated. Concretely, this is a case where a user executes a job under the condition where size A4, type automatic, and a multi-purpose cassette (the paper feed cassette 304 for multi-purpose use) are designated, but the type or size set for the multi-purpose cassette is incompatible to the double-sided printing.

(2) In a case where automatic selection of a paper feed shelf is designated in a job, if there is no paper feed shelf for which paper compatible to the double-sided printing is set, the double-sided printing is determined as inexecutable. Concretely, this is a case where a user executes a job under the condition where A4 size, type automatic, and paper feed shelf automatic selection are designated, but the types or sizes set for the paper feed shelves are all incompatible to the double-sided printing.

(3) In a case where a paper feed shelf grouping operation is designated in a job, if papers set for all the target paper feed shelves are incompatible to the double-sided printing, the double-sided printing is naturally determined as inexecutable. Concretely, this is a case where a user executes a job under the condition where the grouping of the uppermost paper feed cassette 304 and the lowest paper feed cassette 304 is designated, but the types or sizes set for the uppermost and lowest paper feed cassettes 304 are incompatible to the double-sided printing.

The type of a medium determined as incompatible to the double-sided printing is, for example, OHP sheet, thick paper, thin paper, and the like, and when the paper feed shelf (paper feed cassette 304) actually containing such type of papers is designated in each job, the controller 500 determines the type of paper to be used is the OHP sheet, thick paper, or thin paper. Examples of the size incompatible to the double-sided printing are small paper size such as A6 and envelop size, and such size is sensed via the controller 500 to be determined as A6 size or the envelop size.

In a case where the controller 500 thus determines that the double-sided printing is inexecutable in contrary to the job setting by a user, the controller 500 performs the optimum operation control. Hereinafter, examples of the operation control by the controller 500 will be described.

Figure 13:
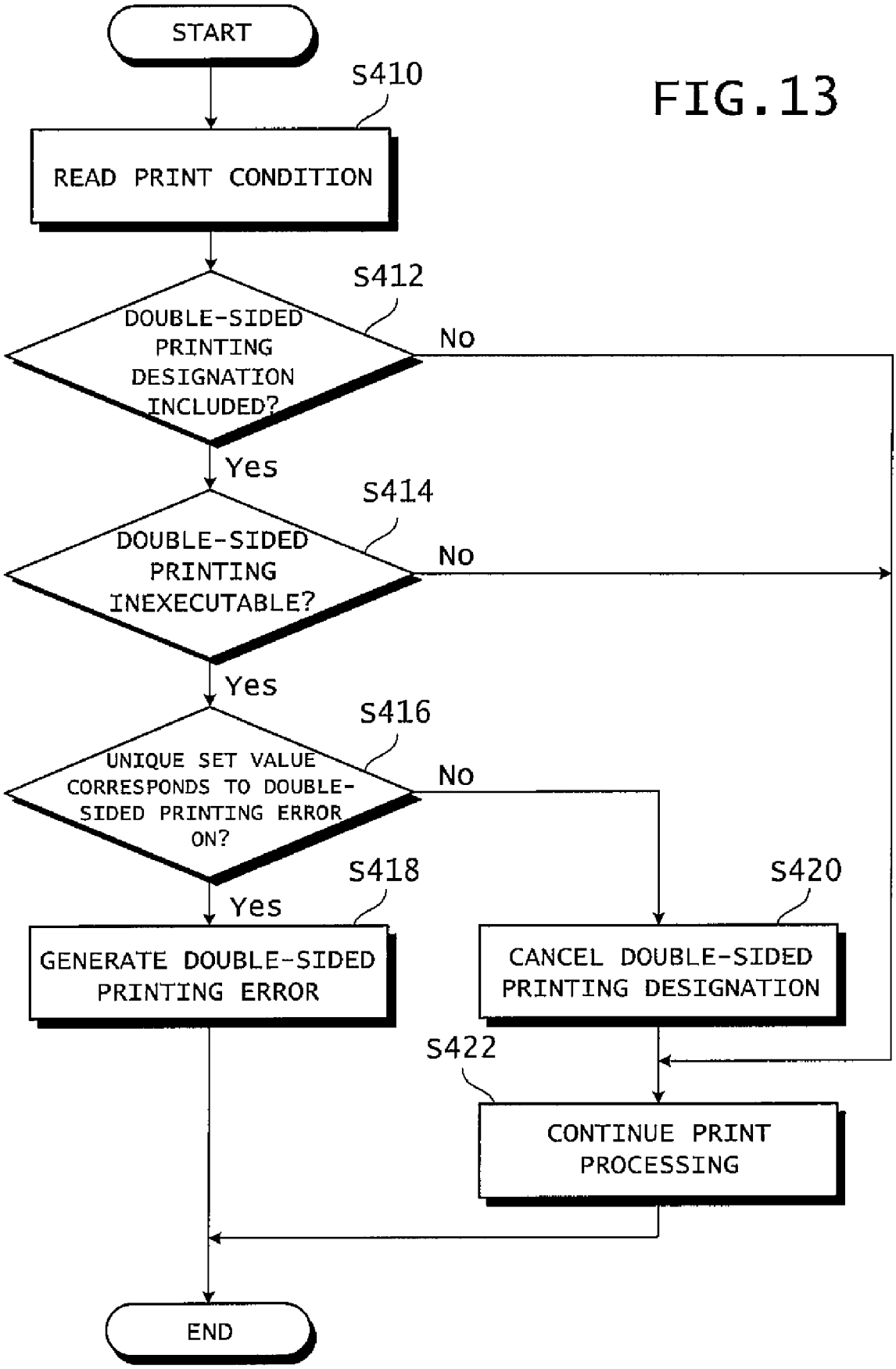
FIG. 13 is a flowchart showing a first example of operation control executed by the controller.

FIG. 13 is a flowchart showing a first example of the operation control executed by the controller 500. After completing the image forming processing (drawing), the controller 500 subsequently executes the operation control in FIG. 13 as the first example. Hereinafter, the concrete procedure will be described in order of events.

Step S410: The controller 500 reads, from the storage unit 504, a print condition set in a current job. As described above, the print condition is decided based on the contents set by a user for each job through the operation panel 502 and is stored in the storage unit 504.

S412: Next, the controller 500 determines whether or not the read print condition includes the setting regarding the double-sided printing designation. When no special setting regarding the double-sided printing designation is included (No), the controller 500 continues the print processing (single-sided printing) (Step S422 in FIG. 13) and once finishes the operation control here. On the other hand, when the setting regarding the double-sided printing designation is included (Yes), the controller 500 goes to the next Step S414.

Step S414: The controller 500 determines whether or not the double-sided printing is executable in the current job. Concretely, the controller 500 determines whether or not the current job corresponds to any of the aforesaid cases where the double-sided printing is inexecutable. When it is determined as a result that the current job does not correspond to any of the cases where the double-sided printing is inexecutable (No), the controller 500 continues the print processing (Step S422 in FIG. 13) and once finishes the operation control. Consequently, the double-sided printing is executed as designated in the job by the user. On the other hand, when the current job corresponds to any of the cases where the double-sided printing is inexecutable (Yes), the controller 500 goes to the next Step S416.

Step S416: The controller 500 determines whether or not a set value unique to the copier 301 (unique set value) indicates that a double-sided printing error should be generated The unique set value mentioned here means a unique value representing what operation (behavior) the copier 301 should take when double-sided printing designated by a user is determined as inexecutable. Such a unique set value is stored in advance in the storage unit 504 of the copier 301, and the unique set value read from the storage unit 504 serves as a basis of the determination at Step S416 by the controller 500.

There are mainly two unique set values, for instance. The first one is a set value corresponding to a series of operations of stopping the operation of the copier 301 and generating the double-sided printing error when the double-sided printing is determined as inexecutable (represented by ON in binary). The second one is a set value corresponding to a series of operations of automatically canceling the designation of the double-sided printing and continuing the processing in the single-sided printing manner without generating the double-sided printing error (represented by OFF) when the double-sided printing is determined as inexecutable. In a case where the copier 301 has the former first unique set value (=ON) (Step S416=Yes), the controller 500 goes to the next Step S418. On the other hand, when the copier 301 has the latter second unique set value (=OFF) (Step S416=No), the controller 500 goes to another Step S420 and then to Step S422. Hereinafter, each of these steps will be described.

Step S418: The controller 500 generates the double-sided printing error based on the unique set value of the copier 301. Accordingly, the controller 500 stops the operation of the copier 301. Further, after generating the double-sided printing error, the controller 500 causes, for example, character information such as an error message to be displayed on the operation panel 502 or error warning sound to be outputted.

Step S420: The controller 500 automatically cancels the designation of the double-sided printing based on the unique set value of the copier 301. Consequently, the double-sided printing designated by the user in the current job is canceled.

Step S422: After canceling the designation of the double-sided printing at Step S420, the controller 500 continues the print processing in this state. In this case, the print processing is performed in the single-sided printing manner.

Figure 14:
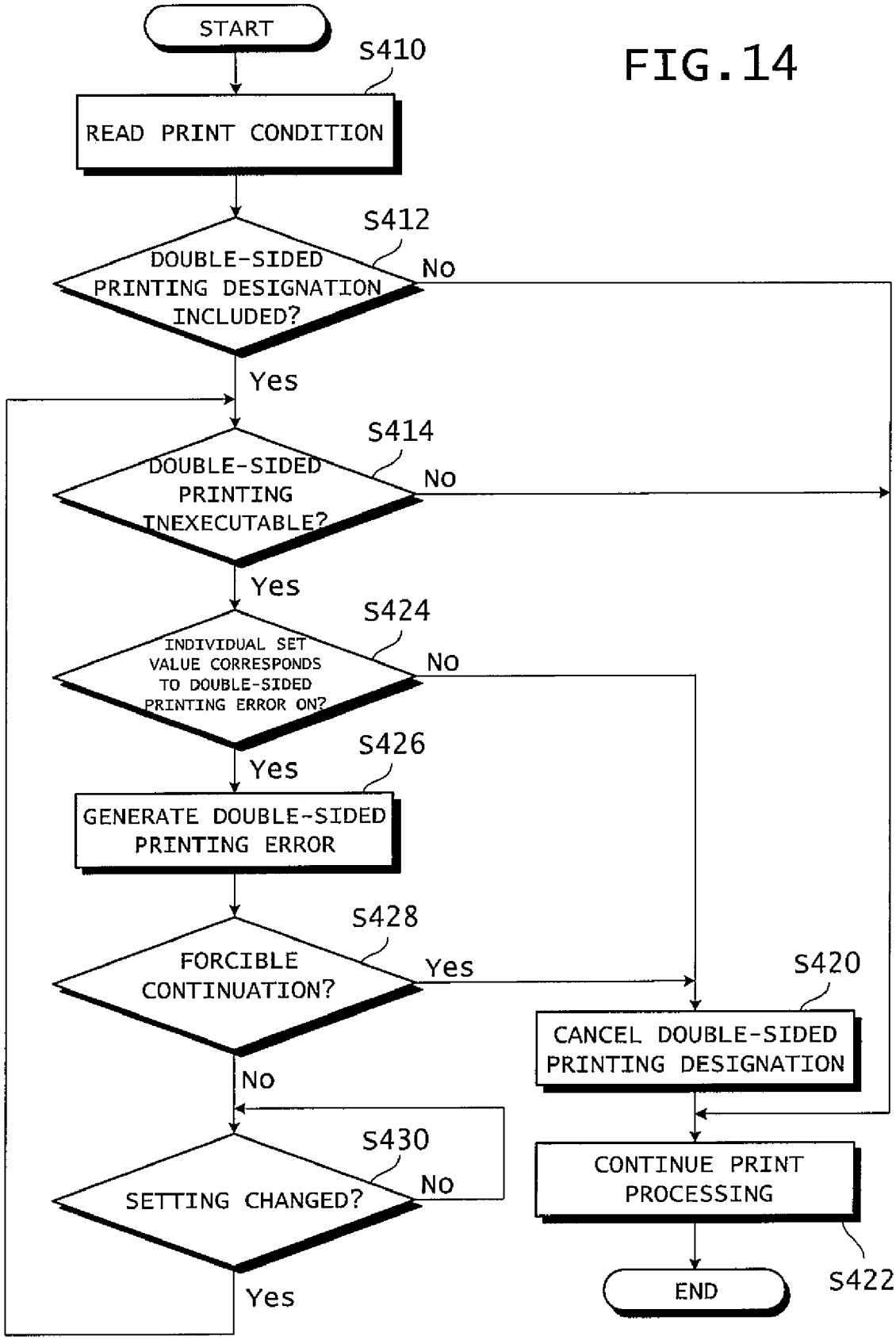
FIG. 14 is a flowchart showing a second example of the operation control executed by the controller.

Next, FIG. 14 is a flowchart of a second example of the operation control executed by the controller 500. After completing the image forming processing (drawing), the controller 500 can also subsequently execute the operation control in FIG. 14 as the second example. Processes at Step S410 to Step S414 in FIG. 14 are the same as those at Step S410 to Step S414 of the first example described previously, and therefore, only different processes will be hereinafter described.

Step S424: The controller 500 determines whether or not an individually set value (individual set value) indicates that a double-sided printing error should be generated. The individual set value mentioned here is a value individually set and representing what operation (behavior) the copier 301 should take when double-sided printing designated in a job is determined as inexecutable. For example, the individual set value can be set for each job executed by a user, for each division where the copier 301 is installed (each section in the same company), for each print color condition (monochrome or full color), or for each paper size (medium type).

For example, when a user designates double-sided printing in a job, the user decides the individual set value for each job by operating the operation panel 502 (selects it from a menu or the like). In this case, the operation panel 502 displays character information saying, "Do you want to stop printing when double-sided printing cannot be executed?" or the like, and also displays menu buttons for "stop printing" and "execute single-sided printing without executing double-sided printing", for instance. The user can decide the individual set value for each job by pressing the menu button as he/she desires.

The set value (ON/OFF) thus individually decided is stored (updated) in the storage unit 504 of the copier 301 every time it is decided. Then, the controller 500 reads the individual set value from the storage unit 504 every time a job is executed in the copier 301 and the read set value serves as a basis of the determination at Step S424 by the controller 500.

There are also mainly two individual set values, but what they indicate are different from those in the first example. Specifically, the first one is a set value corresponding to a series of operations of stopping the operation of the copier 301 to generate the double-sided printing error and request a user's selection (instruction) about a subsequent operation (represented by ON) when double-sided printing designated by the user is determined as inexecutable. The second one is a set value corresponding to a series of operations of automatically canceling the designation of the double-sided printing and continuing the print processing in the single-sided printing manner without generating the double-sided printing error (represented by OFF) when the double-sided printing designated by the user is determined as inexecutable. The user can set which one to use as the individual set value, for each job each time, can set it for each division in advance, or can automatically set it for each job in relation to a print color condition or each used paper size.

In any case, when the former first individual set value (a ON) is given (Step S424=Yes), the controller 500 goes to processes at and after Step S426. On the other hand, when the latter second individual set value (=OFF) is given (Step S424 No), the controller 500 goes to another Step S420 and then to Step S422. Processes in a case where the controller 500 goes from here to Steps S420, S422 are the same as those in the first example described above. Hereinafter, a case where the controller 500 goes from here to Step S426 will be described.

Step S426: The controller 500 generates the double-sided printing error based on the individual set value of the copier 301. Accordingly, the controller 500 stops the operation of the copier 301. Further, after generating the double-sided printing error, the controller 500, for example, causes character information such as an error message to be displayed on the operation panel 502 or causes error warning sound to be outputted.

Step S428: After generating the double-sided printing error, the controller 500 subsequently waits for a user's selection operation. For the selection operation here, the user designates either to cancel the designation of the double-sided printing and continue the print processing in the single-sided printing manner or to change the setting of paper size, paper type, or the like and execute the double-sided printing.

Figure 15:
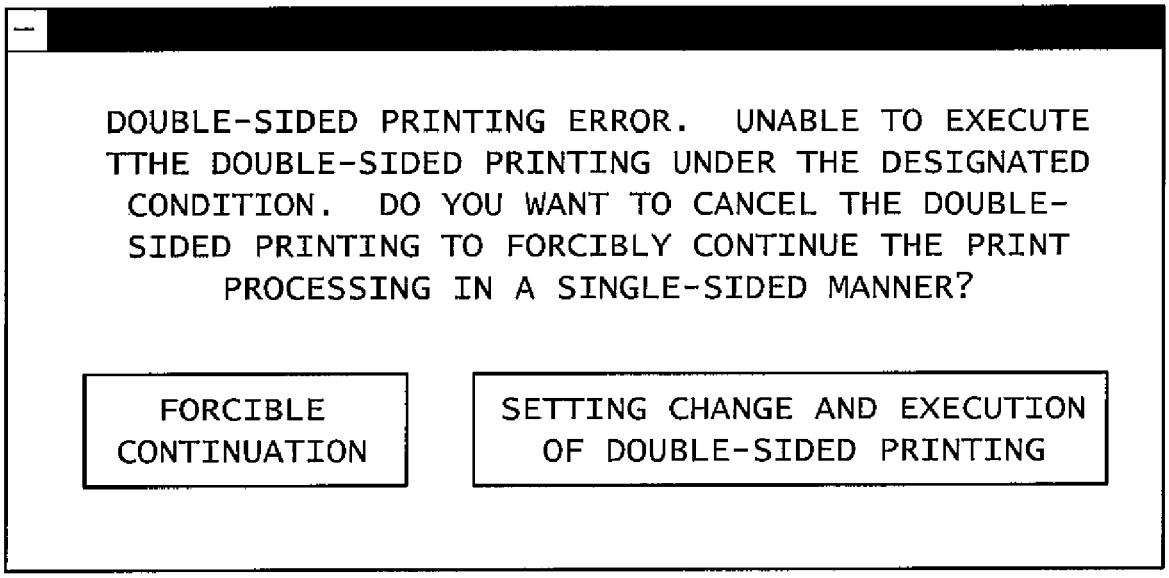
FIG. 15 is a view showing an example of a dialog box displayed on the operation panel when an error occurs.

In this case, as shown in FIG. 15, for instance, the controller 500 displays, on the operation panel 502, a dialog box including character information saying, for example, "Double-sided printing error. Unable to execute the double-sided printing under the designated condition. Do you want to cancel the double-sided printing to forcibly continue the print processing in the single-sided manner?", and also displays operation buttons displaying character information saying, for example, "forcible continuation" and "setting change and execution of double-sided printing" At this time, the user can selectively designate the operation that the copier 301 should subsequently take, by touching one of the operation buttons.

When the user designates the setting change and execution of the double-sided printing and not the forcible continuation at Step S428 (No), the controller 500 goes to the next Step S430. On the other hand, when the user designates the forcible continuation (Yes), the controller 500 goes to Step S420. Hereinafter, the both cases will be described.

Step S430: When the user designates the setting change and execution of the double-sided printing and not the forcible continuation (No) at the previous Step S428, the controller 500 waits until the setting is changed.

The setting change mentioned here means to concretely change the condition setting in order to make the double-sided printing designated in the job executable. For example, when the double-sided printing is determined as inexecutable because the user designates the paper feed shelf (paper feed cassette 304) containing papers whose size or type is not suitable for double-sided printing, the condition under which the double-sided printing is inexecutable is eliminated if the user changes the designation of the paper feed shelf to appropriately change paper size or paper type.

When the user thus performs the operation of concretely changing the setting (Step S430=Yes), the controller 500 returns to Step S414 and determines again whether or not the current job corresponds to any of the cases where the double-sided printing is inexecutable. As a result, if the current job still corresponds to any of the cases where the double-sided printing is inexecutable (Yes), the controller 500 executes the processes at and after Step S424 again. On the other hand, when the current job no longer corresponds to any of the cases where the double-sided printing is inexecutable (No), the controller 500 goes to Step S422 to continue the print processing in the double-sided printing manner.

Step S420: On the other hand, when the user selects and designates the forcible continuation at the previous Step S428 (Yes), the controller 500 cancels the designation itself of the double-sided printing. Consequently, the designation of the double-sided printing set by the user in the current job is forcibly canceled.

Step S422: After canceling the designation of the double-sided printing at Step S420, the controller 500 continues the print processing in this state. In this case, the double-sided printing unit 320 is not used and papers P0 each bearing the printed image on only one surface are discharged in sequence.

Here, the inventors present preferable concrete examples of the individual set value used in the operation control processing shown in FIG. 14 as the second example.

(1) Individual Set Value for Each Organization Division

For example, in a case where a plurality of organization divisions in the same company or the like commonly use the copier 301, a general practice in using the copier 310 is that each division is given a copy card on which an ID code is magnetically recorded in advance and the insertion of the copy card is mandatory for a user to activate the copier 301. In this case, by registering the aforesaid individual set value for each division in the storage unit 504 in advance, it is possible for the controller 500 to identify a division from the ID code of the inserted copy card, read the registered individual set value, and execute the operation control. If the operation to be executed when double-sided printing is determined as inexecutable is thus decided in advance for each division, each user only has to cope with the error according to a manner decided for a division to which the user belongs, so that the user can easily cope with a case where the double-sided printing is actually determined as inexecutable.

(2) Individual Set Value for Each Print Color Condition

For example, the individual set values can be assigned to respective conditions of full color printing and monochrome printing. In this case, in a job of monochrome printing whose unit printing cost is relatively low, the designation of the double-sided printing is automatically canceled and print processing is continued in a single-sided printing manner without generating the double-sided printing error, but in a job of full color printing whose unit printing cost is relatively high, the double-sided printing error is generated and a user's intention (forcible continuation or setting change) can be asked every time. Such an individual set value is effective when an image forming apparatus including a color print function is applied to the image forming system.

According to the first example of the operation control shown in FIG. 13, since a user side assigns a machine-unique set value to the copier 301, it is possible to make the copier 301 always operate in the same pattern as is convenient for the user when the double-sided printing is determined as inexecutable. For example, if stopping the print processing when the double-sided printing is determined as inexecutable is convenient for the user, the unique set value corresponding to this behavior can be assigned, and if, on the other hand, automatically continuing the print processing in the single-sided printing manner when the double-sided printing is determined as inexecutable is convenient for the user, the unique set value corresponding to this behavior can be assigned. In this respect, adopting the first example of the operation control is more convenient for the user compared with a case where only one fixed operation can be taken as a machine.

A user (or a manager or the like) of the apparatus can arbitrarily select which content should be set as the unique operation, in advance before using the apparatus. Therefore, if the user thinks that it is beneficial to give higher priority to avoiding wasteful printing in operating the apparatus, the user can accordingly set the content of the unique operation, and if, on the other hand, the user thinks that it is convenient to change the printing manner to the single-sided printing to execute the print processing even if the double-sided printing is inexecutable, the user can accordingly set the content of the unique operation. Therefore, when the double-sided printing is determined as inexecutable, the operation of the apparatus is not simply stopped, but it is possible to effectively use the apparatus while enhancing convenience for the user in some case.

Further, according to the second example of the operation control shown in FIG. 14, if a user assigns the individual set value for each job, for instance, the user can decide for each job which operation should be performed when double-sided printing is determined as inexecutable. For example, if it is convenient to stop the print processing and reflect a user's intention each time when the double-sided printing is determined as inexecutable in the current job, the user can assign the individual set value corresponding to this behavior. In this case, from the generated error state, the user can recognize that the double-sided printing set in the current job is inexecutable. Then, a user's intention is asked on whether the control should be performed so as to give higher priority to the work by canceling the setting of the double-sided printing or the control should be performed so as to change the condition regarding the double-sided printing (condition of paper size, paper type, or the like) and execute the double-sided printing, and therefore, it is possible to greatly enhance convenience for the user.

On the other hand, if continuing the print processing in the single-sided printing manner even though the double-sided printing is determined as inexecutable is convenient for a user, the user can assign the individual set value corresponding to this behavior. Therefore, adopting the second example is more convenient for the user compared with a case where only one fixed operation can be always taken as a machine.

By thus pre-setting what control should be executed when the double-sided printing designated to the apparatus by a user is inexecutable, it is possible to give higher priority to work efficiency by continuing the operation of printing at one time, and reduce useless printing by stopping the operation at another time. Therefore, when the double-sided printing is determined as inexecutable, the user's work is not simply made stagnant but the setting in which workability is taken into consideration is utilized, and therefore, it is possible to improve work efficiency and to enhance user's convenience.

The above described internal structure of the copier 301 and forms of the various mechanism components are only preferable examples, and the present invention is not limited to those shown in FIG. 11.

Further, the cases where double-sided printing is determined as inexecutable in the copier 301 are only examples, and if other cases are anticipated in a copier with a different structure, the first example or the second example of the operation control can be executed so as to be adapted to such cases.

Besides, the various members and driving components described in the embodiment are only preferable examples, and can be appropriately modified for implementation.

What is claimed is:

1. An image forming system comprising:

an image forming apparatus processing image data page by page and printing, on a paper, an image formed based on the processed image data to discharge the printed paper;

a finisher receiving the printed paper discharged from said image forming apparatus and executing one of an operation of applying predetermined postprocessing to the printed paper to discharge the postprocessed printed paper and an operation of discharging the printed paper discharged from said image forming apparatus without applying the postprocessing to the printed paper; and a controller which:

processes the image data in a unit of a job when said image forming apparatus forms the image;

sets in a job on the basis of an instruction given by a user that said finisher should perform the postprocessing; and when a predetermined error regarding the postprocessing occurs while said image forming apparatus is executing an operation for forming the image in the set state, performs control to make each of said image forming apparatus and said finisher execute a preset unique operation, wherein one of a first unique operation and a second unique operation is selected as the unique operation by said user when said user gives the instruction, the first unique operation being to cancel the setting that said finisher should perform the postprocessing and make said image forming apparatus continue the operation for forming the image, and the second unique operation being to make said image forming apparatus stop the operation for forming the image, generate an error state and wait for an instruction from said user.

2. The image forming system according to claim 1, wherein, when said controller generates the error state based on the second unique operation in the job in which it is set that the postprocessing should be performed, said controller selectively executes one of the following controls on the basis of an instruction which is given by said user after the error state is generated:

to cancel the setting of the postprocessing in the job and make said image forming apparatus continue the operation for forming the image; and to change a condition regarding the postprocessing set in the job and make said finisher execute the postprocessing.

3. An image forming system comprising:

an image forming apparatus processing image data page by page and printing, on a paper, an image formed based on the processed image data to discharge the printed paper;

a finisher receiving the printed paper discharged from said image forming apparatus and executing one of an operation of applying predetermined postprocessing to the printed paper to discharge the postprocessed printed paper and an operation of discharging the printed paper discharged from said image forming apparatus without applying the postprocessing to the printed paper; and a controller which:

processes the image data in a unit of a job when said image forming apparatus forms the image;

sets in a job on the basis of an instruction given by a user that said finisher should perform the postprocessing; and when a predetermined error regarding the postprocessing occurs while said image forming apparatus is executing an operation for forming the image in the set state, performs control to make each of said image forming apparatus and said finisher execute a preset unique operation, wherein one of a first unique operation and a second unique operation is selected as the unique operation on the basis of one of an organization division which said user belongs to, print color condition included in the instruction, and paper size included in the instruction, the first unique operation being to cancel the setting that said finisher should perform the postprocessing and make said image forming apparatus continue the operation for forming the image, and the second unique operation being to make said image forming apparatus stop the operation for forming the image and generate an error state and wait for an instruction from said user.

4. The image forming system according to claim 3, wherein, when said controller generates the error state based on the second unique operation in the job in which it is set that the postprocessing should be performed, said controller selectively executes one of the following controls on the basis of an instruction which is given by said user after the error state is generated:

to cancel the setting of the postprocessing in the job and makes said image forming apparatus continue the operation for forming the image; and to change a condition regarding the postprocessing set in the job and make said finisher execute the postprocessing.

5. An image forming system comprising:

an image forming apparatus processing image data page by page and printing, on a paper, an image formed based on the processed image data to discharge the printed paper;

a finisher receiving the printed paper discharged from said image forming apparatus, and performing one of an operation of applying predetermined postprocessing to the printed paper to discharge the postprocessed printed paper and an operation of discharging the printed paper discharged from said image forming apparatus without applying the postprocessing to the printed paper; and a controller which:

processes the image data in a unit of a job when said image forming apparatus forms the image;

sets in a job on the basis of an instruction given by a user that said finisher should perform the postprocessing;

when a predetermined error regarding the postprocessing occurs while said image forming apparatus is executing an operation for forming the image in the set state, performs control to make each of said image forming apparatus and said finisher execute a predetermined individual operation; and before said image forming apparatus executes the operation for forming the image in the job, sets a content of the individual operation that each of said image forming apparatus and said finisher should execute in the job; and a storage unit storing;

a first individual set value whose content is to cancel the setting that said finisher should perform the postprocessing and make said image forming apparatus continue the operation for forming the image; and a second individual set value whose content is to make said image forming apparatus stop the operation for forming the image to generate an error state and wait for an instruction from a user regarding a subsequent operation, wherein one of the first and second individual set values is selected by said user when said user gives the instruction and said controller sets the content of the individual operation based on the selected individual set value.

6. The image forming system according to claim 5, wherein, when setting the content of the individual operation based on the second individual set value in the job in which it is set that the postprocessing should be performed and accordingly generating the error state, said controller selectively executes one of the following controls on the basis of an instruction which is given by said user after the error state is generated:

to cancel the setting of the postprocessing in the job and make said image forming apparatus continue the operation for forming the image; and to change a condition regarding the postprocessing set in the job and make said finisher execute the postprocessing.

7. The image forming system according to claim 5, wherein said controller sets at least one of punching processing and staple processing as the postprocessing, the punching processing being to punch a hole at a predetermined position of the printed paper, and the staple processing being to stack a plurality of the printed papers to form a copy bundle and bind the copy bundle in an end portion.

8. An image forming system comprising:

an image forming apparatus processing image data page by page and printing, on a paper, an image formed based on the processed image data to discharge the printed paper;

a finisher receiving the printed paper discharged from said image forming apparatus, and performing one of an operation of applying predetermined postprocessing to the printed paper to discharge the postprocessed printed paper and an operation of discharging the printed paper discharged from said image forming apparatus without applying the postprocessing to the printed paper;

a controller which:

processes the image data in a unit of a job when said image forming apparatus forms the image;

sets in a job on the basis of an instruction given by a user that said finisher should perform the postprocessing;

when a predetermined error regarding the postprocessing occurs while said image forming apparatus is executing an operation for forming the image in the set state, performs control to make each of said image forming apparatus and said finisher execute a predetermined individual operation; and before said image forming apparatus executes the operation for forming the image in the job, sets a content of the individual operation that each of said image forming apparatus and said finisher should execute in the job; and a storage unit storing:

a first individual set value whose content is to cancel the setting that said finisher should perform the postprocessing and make said image forming apparatus continue the operation for forming the image; and a second individual set value whose content is to make said image forming apparatus stop the operation for forming the image to generate an error state and wait for an instruction from said user regarding a subsequent operation, wherein one of the first and second individual set values is selected on the basis of one of an organization division which said user belongs to, print color condition included in the instruction, and paper size included in the instruction and said controller sets the content of the individual operation based on the selected individual set value.

9. The image forming system according to claim 8, wherein, when setting the content of the individual operation based on the second individual set value in the job in which it is set that the postprocessing should be performed and accordingly generating the error state, said controller selectively executes one of the following controls on the basis of an instruction which is given by said user after the error state is generated:

to cancel the setting of the postprocessing in the job and make said image forming apparatus continue the operation for forming the image; and to change a condition regarding the postprocessing set in the job and make said finisher execute the postprocessing.

10. An image forming system comprising:

an image forming apparatus processing image data page by page and printing, on a paper, an image formed based on the processed image data to discharge the printed paper;

a finisher receiving the printed paper discharged from said image forming apparatus and executing one of an operation of applying predetermined postprocessing to the printed paper to discharge the postprocessed printed paper and an operation of discharging the printed paper discharged from said image forming apparatus without applying the postprocessing to the printed paper; and a controller which:

processes the image data in a unit of a job when said image forming apparatus forms the image;

sets in a job on the basis of an instruction given by a user that said finisher should perform the postprocessing; and when a predetermined error regarding the postprocessing occurs while said image forming apparatus is executing an operation for forming the image in the set state, performs control to make said image forming apparatus stop the operation for forming the image to generate an error state, and when confirming afterward that the error is not continuously occurring, performs control to make said image forming apparatus continue the operation for forming the image; and an operation panel for said user to select one of the following controls when said controller generates the error state in the job in which it is set that the postprocessing should be performed:

to cancel the setting of the postprocessing in the job and make said image forming apparatus continue the operation for forming the image; and to change a condition regarding the postprocessing set in the job and make said finisher execute the postprocessing, wherein said controller performs the selected control after said controller generate the error state.

11. The image forming system according to claim 10, wherein said controller sets at least one of punching processing and staple processing as the postprocessing, the punching processing being to punch a hole at a predetermined position of the printed paper, and the staple processing being to stack a plurality of the printed papers to form a copy is bundle and bind the copy bundle in an end portion.

12. An image forming system comprising:

an image forming apparatus processing image data page by page and printing, on a paper, an image formed based on the processed image data to discharge the printed paper;

a finisher receiving the printed paper discharged from said image forming apparatus and executing one of an operation of applying predetermined postprocessing to the printed paper to discharge the postprocessed printed paper and an operation of discharging the printed paper discharged from said image forming apparatus without applying the postprocessing to the printed paper; and a controller which:

processes the image data in a unit of a job when said image forming apparatus forms the image;

sets in a job on the basis of an instruction given by a user that said finisher should perform the postprocessing: and when a predetermined error regarding the postprocessing occurs while said image forming apparatus is executing an operation for forming the image in the set state, performs control to make each of said image forming apparatus and said finisher execute a preset unique operation, wherein one of a first unique operation and a second unique operation is selected as the unique operation by said user when said user gives the instruction, the first unique operation being to make said image forming apparatus stop the operation for forming the image and save the image data and the setting regarding the postprocessing, and the second unique operation being to cancel the setting that the postprocessing should be performed and make said image forming apparatus execute the operation for forming the image.

13. An image forming system comprising:

an image forming apparatus processing image data page by page and printing, on a paper, an image formed based on the processed image data to discharge the printed paper;

a finisher receiving the printed paper discharged from said image forming apparatus and executing one of an operation of applying predetermined postprocessing to the printed paper to discharge the postprocessed printed paper and an operation of discharging the printed paper discharged from said image forming apparatus without applying the postprocessing to the printed paper;

a storage unit capable of saving information; and a controller which:

processes the image data in a unit of a job when said image forming apparatus forms the image;

sets in a job on the basis of an instruction given by a user that said finisher should perform the postprocessing; and when a predetermined error regarding the postprocessing occurs while said image forming apparatus is executing an operation for forming the image in the set state, performs control to make each of said image forming apparatus and said finisher execute a preset unique operation, wherein one of a first unique operation and a second unique operation is selected as the unique operation by said user when said user gives the instruction, the first unique operation being to cancel the setting of the postprocessing in the job and make said image forming apparatus continue the operation for forming the image, and the second unique operation being to save, as the information, the image data and the setting regarding the postprocessing in said storage unit without executing the operation for forming the image by said image forming apparatus.

14. The image forming system according to claim 13, wherein the second unique operation is to make said image forming apparatus stop the operation for forming the image to generate an error state before saving the image data and the setting regarding the postprocessing in said storage unit, and is to cancel the error state after saving the image data and the setting regarding the postprocessing in said storage unit.

15. The image forming system according to claim 13, wherein, after saving image data processed for a specific job in said storage unit, said controller subsequently processes image data for another job and performs control to make said image forming apparatus execute the operation for forming an image by using the subsequently processed image data.

16. The image forming system according to claim 13, wherein, in a case where the image data and the setting regarding the postprocessing are saved in said storage unit for the job in which it is set that the postprocessing should be performed, said controller selectively executes one of the following controls on the basis of an instruction given by said user after saving the setting:

to cancel the setting of the postprocessing in the job and make said image forming apparatus continue the operation for forming the image; and to change a condition regarding the postprocessing set in the job and make said finisher execute the postprocessing.

17. The image forming system according to claim 13, further comprising a timer for counting a preset designated time when an error regarding the postprocessing occurs, wherein the image data and the setting regarding the postprocessing are saved in said storage unit after the timer counts up to the preset designated time.

18. An image forming system comprising:

an image forming apparatus processing image data page by page and printing, on a paper, an image formed based on the processed image data to discharge the printed paper;

a finisher receiving the printed paper discharged from said image forming apparatus and executing one of an operation of applying predetermined postprocessing to the printed paper to discharge the postprocessed printed paper and an operation of discharging the printed paper discharged from said image forming apparatus without applying the postprocessing to the printed paper;

a storage unit capable of saving information; and a controller which:

processes the image data in a unit of a job when said image forming apparatus forms the image;

sets in a job on the basis of an instruction given by a user that said finisher should perform the postprocessing; and when a predetermined error regarding the postprocessing occurs while said image forming apparatus is executing an operation for forming the image in the set state, performs control to make each of said image forming apparatus and said finisher execute a preset unique operation, wherein one of a first unique operation and a second unique operation is selected as the unique operation on the basis of one of an organization division which said user belongs to, print color condition included in the instruction, and paper size included in the instruction, the first unique operation being to cancel the setting of the postprocessing in the job and make said image forming apparatus continue the operation for forming the image, and the second unique operation being to save, as the information, the image data and the setting regarding the postprocessing in said storage unit without executing the operation for forming the image by said image forming apparatus.

* * * * *